US008591284B2

(12) United States Patent
Dubois

(10) Patent No.: US 8,591,284 B2
(45) Date of Patent: Nov. 26, 2013

(54) TOY WITH HOUSING HAVING MOVABLE COMPONENTS

(75) Inventor: David M. Dubois, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 542 days.

(21) Appl. No.: 12/559,134

(22) Filed: Sep. 14, 2009

(65) Prior Publication Data

US 2010/0075573 A1 Mar. 25, 2010

Related U.S. Application Data

(60) Provisional application No. 61/100,261, filed on Sep. 25, 2008.

(51) Int. Cl.
*A63H 3/52* (2006.01)

(52) U.S. Cl.
USPC ..... 446/476; 446/423

(58) Field of Classification Search
USPC ..... 446/423, 476–478, 487
See application file for complete search history.

(56) References Cited

U.S. PATENT DOCUMENTS

| | | | | |
|---|---|---|---|---|
| 1,678,179 | A | 7/1928 | Brueck | |
| 2,036,802 | A * | 4/1936 | Fleishman et al. | 446/423 |
| 2,283,104 | A * | 5/1942 | Surman | 446/83 |
| 2,412,681 | A | 12/1946 | Fuerst | |
| 2,776,522 | A | 1/1957 | Schramm et al. | |
| 3,694,953 | A * | 10/1972 | Tomiyama | 446/423 |
| 3,735,525 | A | 5/1973 | Freed | |
| 3,797,164 | A | 3/1974 | Glass et al. | |
| 4,139,967 | A * | 2/1979 | Kuna et al. | 446/476 |
| 4,257,601 | A | 3/1981 | Kurita | |
| 4,348,093 | A | 9/1982 | Haag | |
| 4,536,162 | A * | 8/1985 | Ace et al. | 446/487 |
| 4,655,726 | A * | 4/1987 | Brzezinski et al. | 446/268 |
| 5,440,996 | A | 8/1995 | Cottino | |
| 5,696,333 | A * | 12/1997 | Shih | 446/482 |
| 5,797,219 | A | 8/1998 | Croswell | |
| 5,815,987 | A * | 10/1998 | Beasley | 52/65 |
| 6,099,380 | A * | 8/2000 | Rasmussen | 446/476 |

(Continued)

FOREIGN PATENT DOCUMENTS

JP 1145640 6/1989

OTHER PUBLICATIONS http://www.toyrus.com/product/index.jsp?productId=2310852, Imaginext: Adventures Castle Bonus Set—Fisher-Price—Toys "R" Us, 7 pages.

(Continued)

*Primary Examiner* — Gene Kim
*Assistant Examiner* — Urszula M Cegielnik
(74) *Attorney, Agent, or Firm* — Edell, Shapiro & Finnan, LLC

(57) ABSTRACT

The present invention relates to a toy or toy playset that includes a housing with a movable door and a movable platform. In one embodiment, the door is placed proximate to an opening in the housing and can be moved between a lowered position and a raised position. In one embodiment, the platform is movably mounted to the housing and is movable about an axis. The door and the platform are configured to be moved at the same time. In one implementation, the platform can be moved as the door moves from its lowered position to its raised position.

20 Claims, 21 Drawing Sheets

(56) References Cited

U.S. PATENT DOCUMENTS

| | | | | |
|---|---|---|---|---|
| 6,174,234 | B1 | 1/2001 | Seibert, Jr. et al. | |
| 6,227,931 | B1 | 5/2001 | Shackelford | |
| 6,406,350 | B2 | 6/2002 | Yoneda et al. | |
| 6,773,329 | B2 * | 8/2004 | Hornsby et al. | 446/475 |
| 6,852,000 | B2 * | 2/2005 | Lee et al. | 446/476 |
| 7,033,243 | B2 | 4/2006 | Hornsby et al. | |
| 7,371,148 | B2 * | 5/2008 | Marine et al. | 446/476 |
| 7,537,509 | B2 * | 5/2009 | Payne et al. | 446/444 |
| 2005/0287926 | A1 | 12/2005 | Marine et al. | |

OTHER PUBLICATIONS http://www.amazon.co.uk/Construction-C3-Classic-Batcave-447pc/d . . . , Amazon.co.uk: Construction C3 Classic—Batcave 447pc: Toys & Games, 2 pages.

* cited by examiner

TOY WITH HOUSING HAVING MOVABLE COMPONENTS

CROSS-REFERENCE TO RELATED APPLICATION

This application claims priority to U.S. Provisional Patent Application Ser. No. 61/100,261, entitled "Toy with Housing Having Moveable Components," filed Sep. 25, 2008, the disclosure of which is incorporated herein by reference in its entirety.

FIELD OF THE INVENTION

The present invention relates to a toy or toy playset that includes a housing having movable components. In particular, the present invention relates to a housing that has movable components that can be used with a toy vehicle. In one embodiment, the movable components can include a door and a platform that are coupled to the housing.

BACKGROUND OF THE INVENTION

There are many types of toys or toy playsets with which a child can play. Some toys include a housing that can be used to enhance the play of the child. Typically, a toy figure or a toy vehicle can be used with the housing by a child to facilitate the creative play of the child.

A need exists for a toy or toy playset that enhances the play opportunities for a child.

SUMMARY OF THE INVENTION

The present invention relates to a toy or toy playset that can be used by a child. In one embodiment, the toy includes a housing with a door and a platform, each of which is movably coupled to the housing. In one embodiment, the movement of the door and the movement of the platform can be coordinated so that the platform moves as the door moves in a particular direction. In one embodiment, the housing may include an actuating mechanism that is connected to the door and to the platform. Operation of the actuating mechanism can result in movement of the door and movement of the platform.

In one embodiment, the invention relates to a toy playset that includes a housing, the housing including a wall having an inner side and an outer side, the wall defining an opening extending from the inner side to the outer side, and the housing defining a receiving area. The toy playset may include a door, the door being coupled to the wall proximate to the opening, and the door being movable between a raised position and a lowered position. The toy playset may include a platform, the platform being movably mounted to the housing and located in the receiving area, the platform being movable from a first position to a second position, the platform moving from its first position to its second position as the door moves from its raised position to its lowered position.

In one embodiment, the door and the platform are configured so that a toy vehicle can be moved from the outer side of the housing to the inner side of the housing along the door and onto the platform. In one embodiment, the platform is configured to receive the toy vehicle. In another embodiment, the platform is configured to move so that a toy vehicle disposed on the platform in a first orientation relative to the opening while the door is in its raised position is moved to a second orientation relative to the opening when the platform moves from its first position to its second position. In another embodiment, the toy vehicle is oriented away from the opening in its first orientation and the toy vehicle is oriented toward the opening in its second orientation.

In another embodiment, the toy playset can include a toy vehicle, the toy vehicle being disposable in a first orientation relative to the opening when the platform is in its first position, the toy vehicle moving to a second orientation relative to the opening as the platform moves to its second position, the second orientation being opposite to the first orientation. In one embodiment, the platform remains stationary as the door moves from its lowered position to its raised position. In another embodiment, the platform rotates approximately 180° as the platform moves from its first position to its second position.

In one embodiment, the toy playset includes an actuator, the actuator being coupled to the housing and movable in a first direction and in a second direction opposite to the first direction, the actuator being coupled to the door and to the platform, and movement of the actuator in the first direction causes the platform to rotate and the door to move from its lowered position to its raised position. In addition, the movement of the actuator in the second direction causes the platform to rotate and the door to move from its raised position to its lowered position.

In one embodiment, the toy playset includes a first coupling mechanism, the first coupling mechanism being operably coupled to the actuator and to the platform, and a second coupling mechanism, the second coupling mechanism being operably coupled to the actuator and to the door, and movement of the actuator causes actuation of the first coupling mechanism and the second coupling mechanism. In one embodiment, the actuator can include an engagement portion and the platform can include an engagement portion, the first coupling mechanism includes a first portion and a second portion, the first portion of the first coupling mechanism being configured to operably engage the engagement portion of the actuator, and the second portion of the first coupling mechanism being configured to operably engage the engagement portion of the actuator. In addition, the door includes an engagement portion, the second coupling mechanism includes a first portion and a second portion, the first portion of the second coupling mechanism being configured to operably engage the engagement portion of the actuator, and the second portion of the second coupling mechanism being configured to operably engage the engagement portion of the door.

In one embodiment, the present invention relates to a method of using a toy vehicle with a toy housing, the toy housing having a platform movably coupled to the housing and a door movably coupled to the housing, the method comprising the steps of: disposing a toy vehicle on the platform in a first orientation relative to the housing, moving the door from a lowered position to a raised position, and moving the door from the raised position to the lowered position, wherein movement of the door from the raised position to the lowered position causes the platform to move from a first position to a second position, the toy vehicle being in its first orientation when the platform is in its first position, and the toy vehicle is in a second orientation opposite to the first orientation when the platform is in its second position.

In one embodiment, the step of moving the door from the raised position to the lowered position causes the platform to rotate from its first position to its second position. In one embodiment, the platform moves approximately 180° as the platform moves from its first position to its second position. The toy housing includes an actuator coupled thereto, the actuator is operably coupled to the platform and to the door, and the step of moving the door from the raised position to the lowered position includes moving the actuator in a first direction.

In another embodiment, the present invention relates to a toy that includes a housing, the housing defining an opening extending therethrough, a door, the door being coupled to the housing proximate to the opening, the door being movable between a raised position in which the door closes a portion of the opening and a lowered position in which the door forms a ramp up to the opening, a platform, the platform being rotatably coupled to the housing, the platform being movable from a first position to a second position as the door is moved from its raised position to its lowered position, and a toy vehicle, the toy vehicle being configured to be moved along the door, the toy vehicle being disposable on the platform in a first orientation when the platform is in its first position, and the toy vehicle being moved to a second orientation as the platform moves from its first position to its second position, the second orientation being different than the first orientation.

In one embodiment, the platform is mounted for movement around an axis, the platform being configured to move incrementally in a direction around the axis for each movement of the door from its lowered position to its raised position. The toy may also include an actuator, the actuator being operably coupled to the door and to the platform, the actuator being configured to be moved in a first direction and in a second direction opposite to the first direction, movement of the actuator in the first direction causes the door to move from its lowered position to its raised position and the platform from its first position to its second position, and movement of the actuator in the second direction cause the door to move from its raised position to its lowered position and the platform from its second position to its first position. In addition, the toy vehicle can be facing away from the door when the toy vehicle is in its first position and the toy vehicle is facing toward the door when the toy vehicle is in its second position.

BRIEF DESCRIPTION OF THE DRAWINGS

Like reference numerals have been used to identify like elements throughout this disclosure.

DETAILED DESCRIPTION OF THE INVENTION

The present invention relates to a toy or toy playset that includes a housing with a movable door and a movable platform. In one embodiment, the door is placed proximate to an opening in the housing and can be moved between a lowered position and a raised position. In one embodiment, the platform is movably mounted to the housing and is movable about an axis. The door and the platform are configured to be moved at the same time. In one implementation, the platform can be moved as the door moves from its lowered position to its raised position.

The terms "toy" and "toy playset" may be used interchangeably herein. The term "door" is intended to cover any structure that can be positioned near an opening on the housing of the toy and cover a portion of the opening. The "door" may be referred to as a "draw bridge" or a "ramp" as well.

Figure 1:
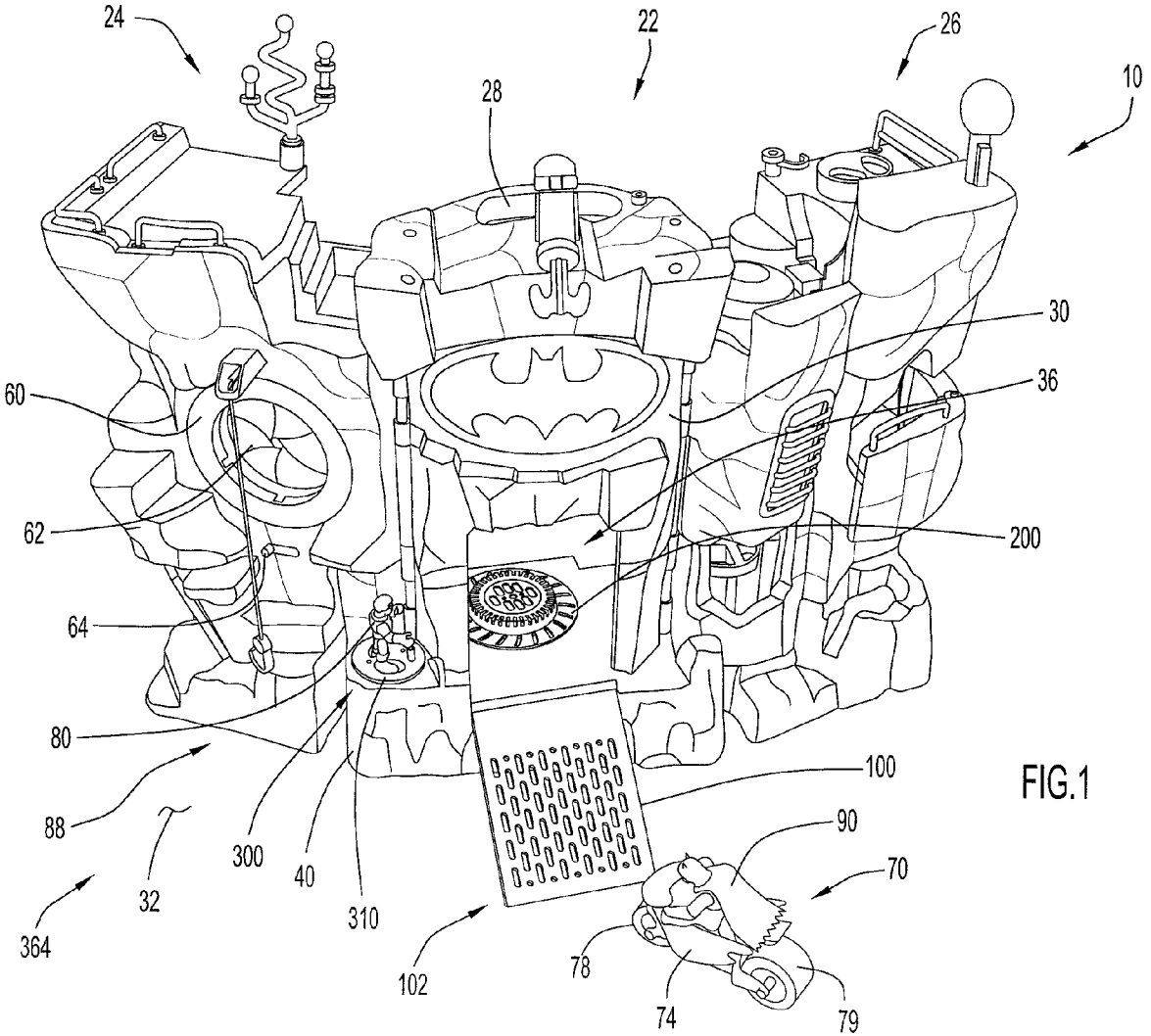
FIG. 1 illustrates a front perspective view of an embodiment of a toy according to the present invention.

Referring to FIG. 1, a front perspective view of an exemplary embodiment of a toy or toy playset according to the present invention is illustrated. In particular, the toy 10 includes a housing 20 that has multiple portions that are movably coupled together. As shown, housing 20 includes a center portion 22 and side portions 24 and 26 that are each pivotally coupled to the center portion 22. While the portions 22, 24, and 26 are illustrated in FIG. 1 in an expanded configuration, the side portions 24 and 26 can be pivoted relative to the center portion 22 and toward each other so that the housing 20 has a collapsed configuration. An upper portion of the housing 20 can include a handle 28 that can be grasped by a user to transport the housing 20.

In various embodiments, the housing 20 can have different configurations and appearances. In the illustrated embodiment, the housing 20 has an overall cave-like appearance and is configured to resemble the bat cave for the character BATMAN. In other embodiments, the housing 20 may have any number of portions or sections that are fixed or movable relative to each other.

In this embodiment, the housing 20 includes a wall 30 that defines an outer side 32 and an inner side 34 (see FIG. 3) Referring to FIG. 1, the wall 30 defines an opening 36 that is configured to allow a toy vehicle or other object to pass therethrough. In particular, the opening 36 is configured to allow an object to move from the outer side 32 of the housing 20 to the inner side 34 of the housing 20 and back to the outer side 32 as desired.

Figure 3:
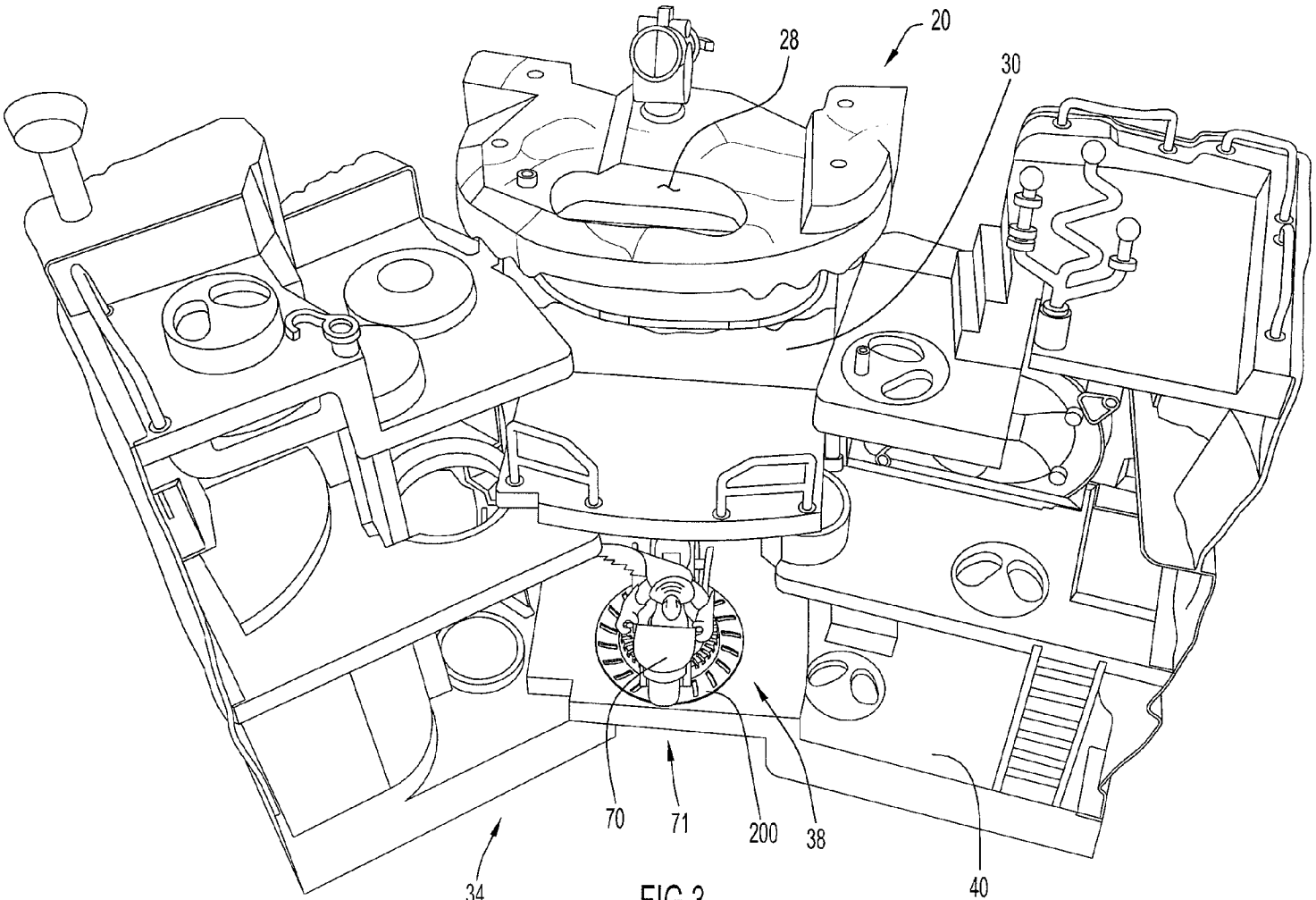
FIG. 3 illustrates a rear perspective view of the toy illustrated in FIG. 1.
Figure 4:
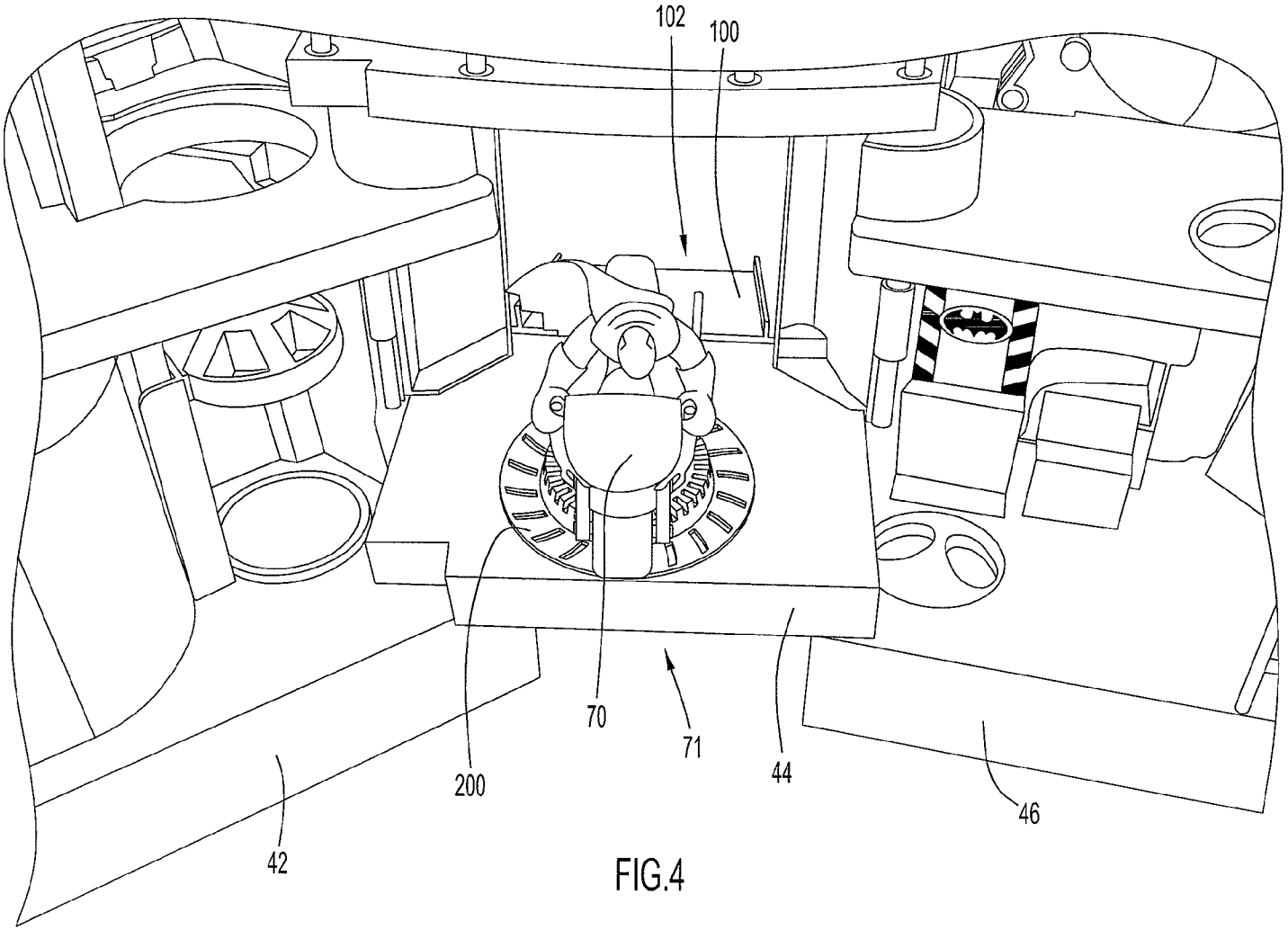
FIG. 4 illustrates a rear perspective view of a portion of the toy illustrated in FIG. 3.

Referring to FIG. 3, the housing 20 defines a receiving area 38 which corresponds to the inner side 34 of the housing 20. As shown, the housing 20 can include a base 40 and several platforms above the base 40 that can provide different areas or rooms in which the child can play with a toy figure. As shown in FIG. 4, the center 22 and side portions 24 and 26 can have different base portions 44, 42 and 46, respectively, with the centrally located base portion 44 being higher than base portions 42 and 46 to facilitate the collapsing of the housing 20.

Figure 6:
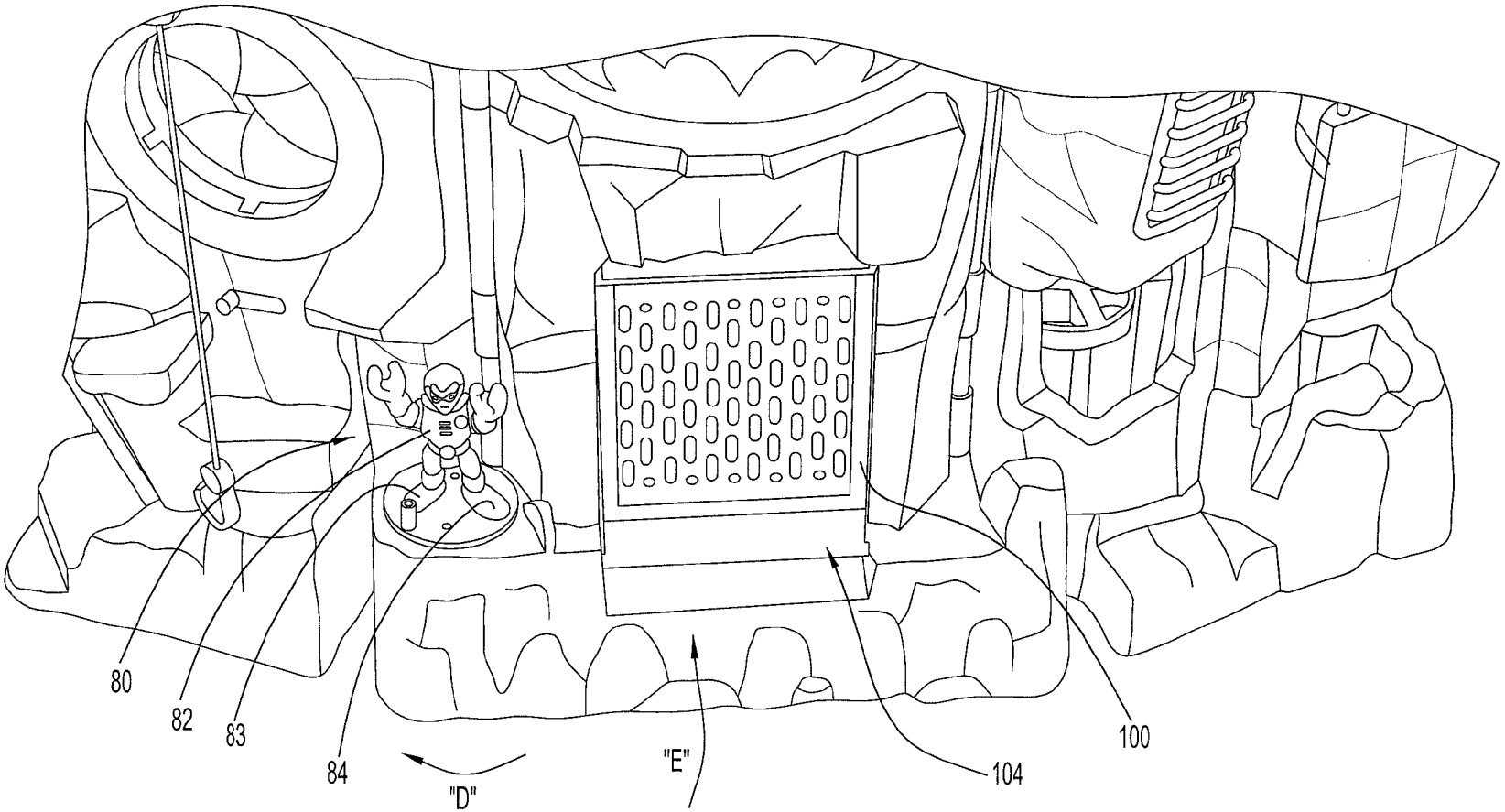
FIG. 6 illustrates a front perspective view of the toy illustrated in FIG. 5 with the door in a raised position.

Referring back to FIG. 1, the housing includes an opening 60 in which a closure mechanism with multiple plates 62 is disposed therein. The plates 62 are mounted for pivotal movement in a "camera shutter-like" manner and are movable upon the movement of the slide actuator 64. Also useable with the housing 20 is a toy FIG. 80, a toy FIG. 90, and a toy vehicle 70. As shown in FIG. 6, the toy FIG. 80 includes a body 82 with feet 83 and 84 that can be placed into respective recesses in various actuators disposed around the housing 20 to cause movement of different components of the housing 20.

Figure 32:
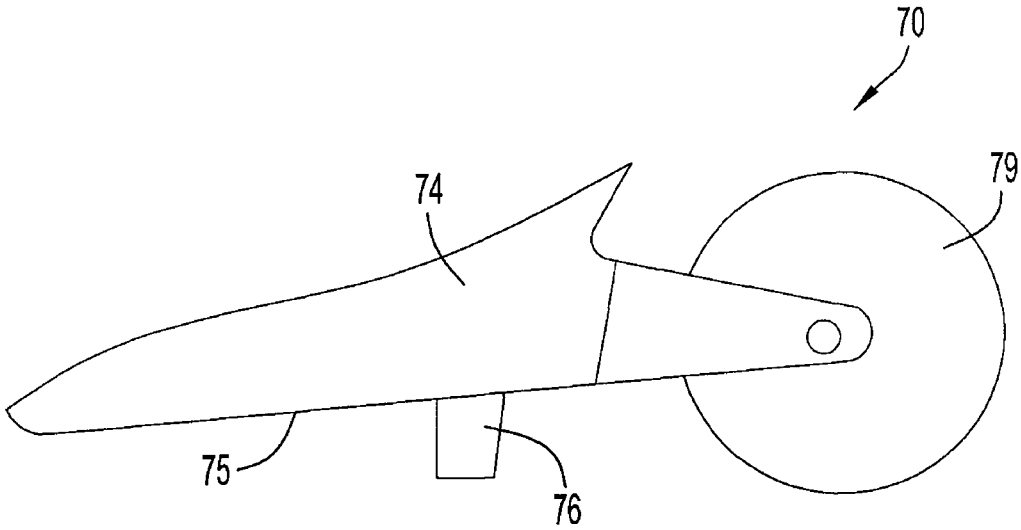
FIG. 32 illustrates a side view of a portion of an embodiment of a toy vehicle according to the present invention.
Figure 33:
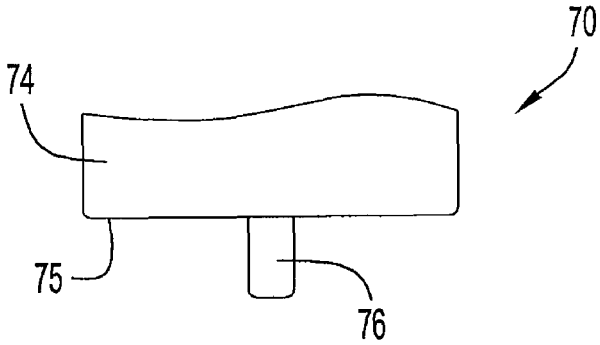
FIG. 33 illustrates a front view of the portion of the toy vehicle illustrated in FIG. 32.

Referring back to FIG. 1, toy FIG. 90 is shown mounted on the toy vehicle 70. While toy vehicle 70 is illustrates a cycle, in different embodiments, the configuration and size of the toy vehicle 70 can vary. For example, the toy vehicle 70 can be a car such as the BATMOBILE in different embodiments. Referring to FIGS. 32 and 33, a portion of the toy vehicle 70 is illustrated. As shown, the body 74 of the toy vehicle 70 has a front end 77A and a rear end 77B and also includes a lower surface 75 that has an extension or projection 76 extending therefrom. The toy vehicle 70 can be formed of plastic and the extension 76 can be integrally formed therewith. Alternatively, the extension 76 can be formed separately from the toy vehicle 70 and subsequently coupled thereto.

Figure 2:
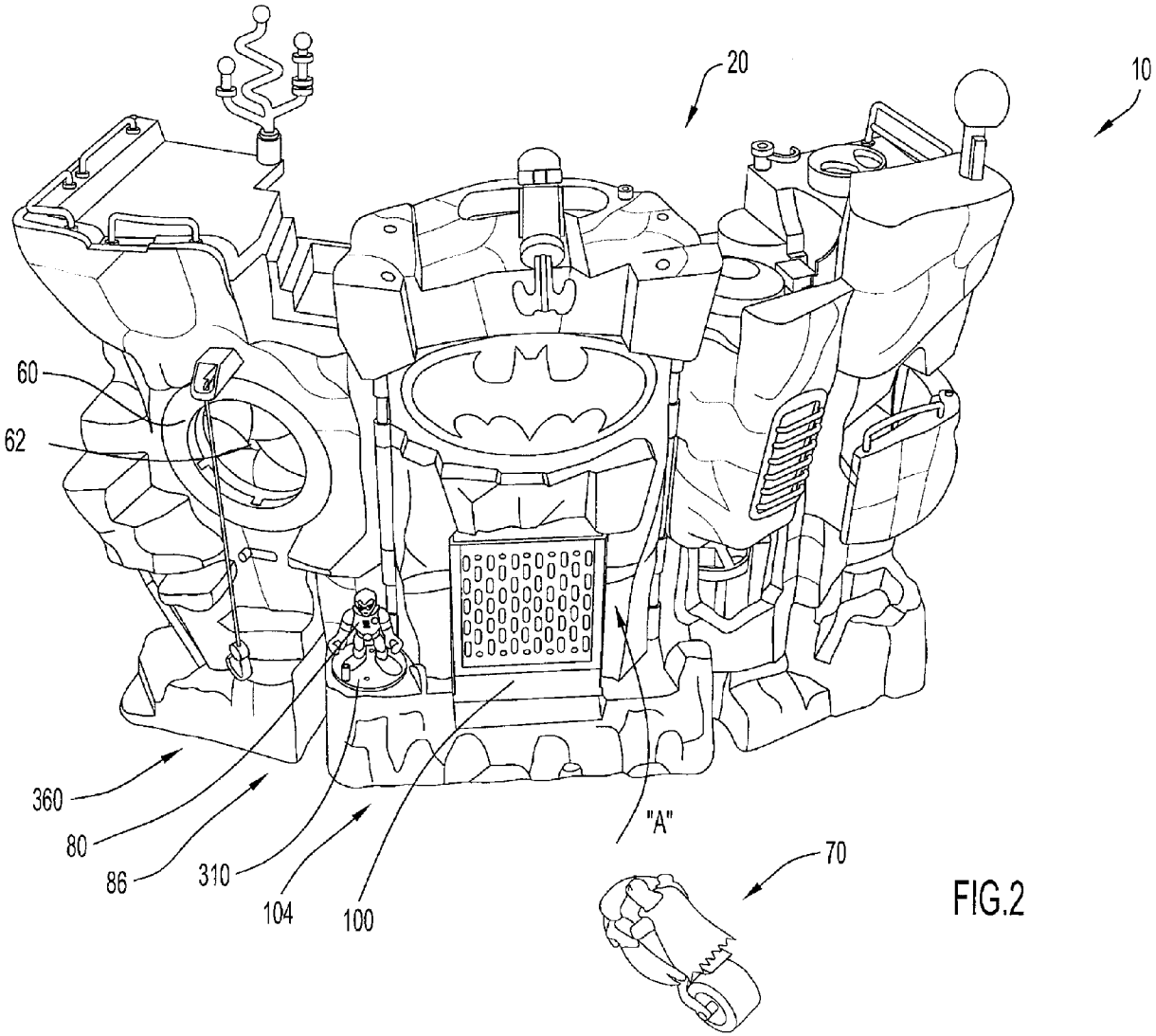
FIG. 2 illustrates a front perspective view of the toy illustrated in FIG. 1 with the door in a raised position.

As illustrated in FIG. 1, the housing 20 includes a ramp or door 100 that is coupled to the housing 20. The door 100 is disposed proximate to the opening 36 and in one embodiment, is configured to cover substantially all of the opening 36. The door 100 can be moved between a lowered position 102 (as shown in FIG. 1) and a raised position 104 (as shown in FIG. 2) along the direction of arrow "A" in FIG. 2.

Referring to FIG. 1, the housing 20 also includes a platform 200 that is coupled to the housing 20. In particular, the platform 200 is movably mounted to the base 40. The toy vehicle 70 can drive up the lowered door 100 and can be placed on the platform 200 as shown in FIGS. 3 and 4. When the toy vehicle 70 is driven by a child up the door 100 and onto the platform 200, the toy vehicle 70 is disposed in a first orientation 71 (see FIGS. 3 and 4) in which the toy vehicle 70 is oriented away from the opening 36 and the door 100.

The housing 20 also includes an actuating mechanism 300 that is coupled to the housing 20. The toy FIG. 80 is illustrated in FIG. 1 as being placed on an actuator or activation disk 310, which is part of the actuating mechanism 300. In FIG. 1, the toy FIG. 80 is located in a particular orientation 88 relative to the housing 20. Referring to FIG. 2, the toy FIG. 80 and the actuator 310 have been rotated so that the toy FIG. 80 is disposed in a different orientation 86 and the actuator 310 is in a different orientation 360. The movement of the actuator 310 (and toy FIG. 80) from the orientations 364 and 88 in FIG. 1 to orientations 360 and 86 in FIG. 2 results in the door 100 moving along the direction of arrow "A" from its lowered position 102 to its raised position 104. Likewise, movement of the actuator 310 in the opposite direction results in movement of the door 100 from its raised position 104 to its lowered position 102.

Figure 5:
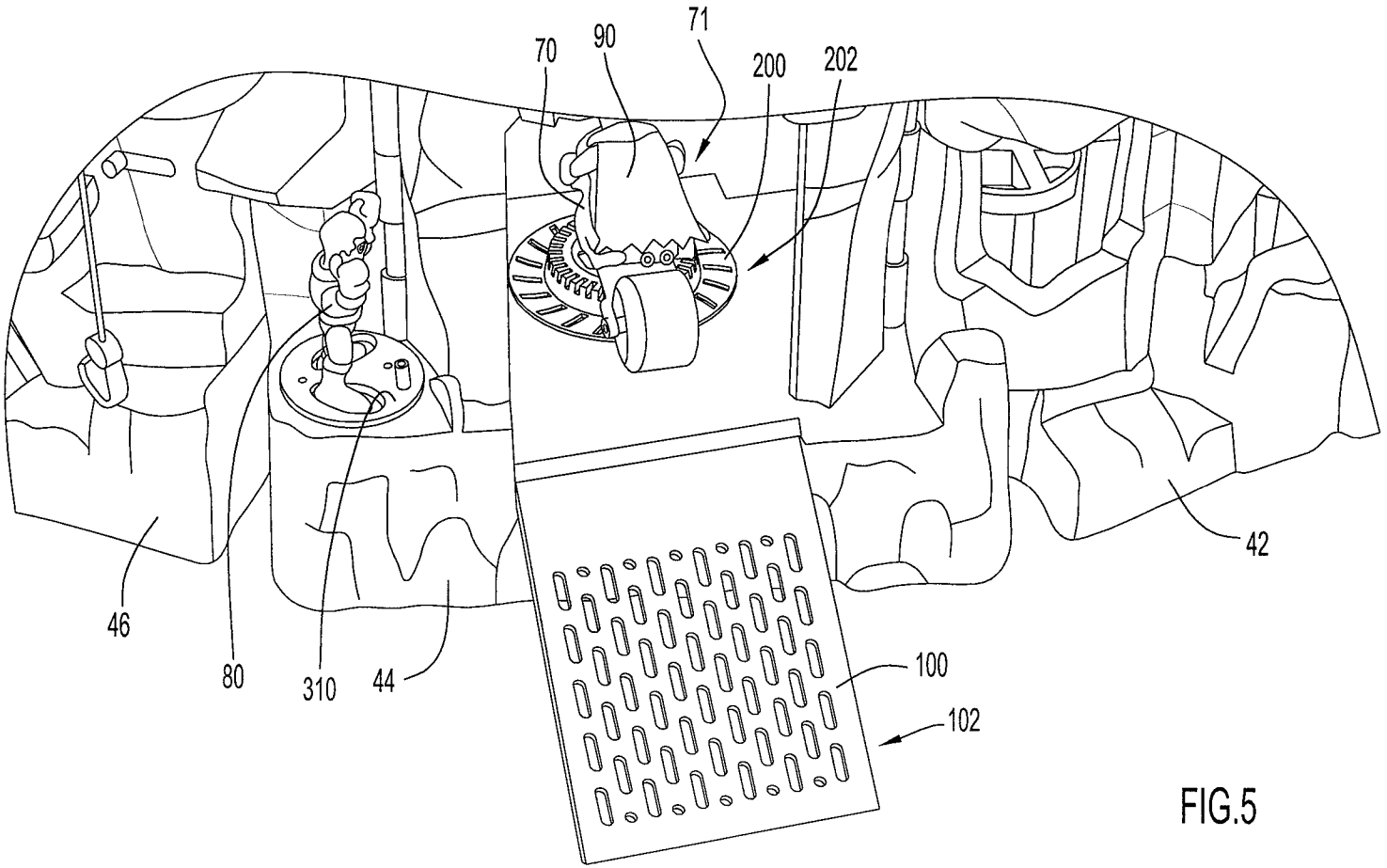
FIG. 5 illustrates a front perspective view of a portion of the toy illustrated in FIG. 1 with the door in a lowered position and the platform in a first orientation.

Referring to FIGS. 5-9, the movement of the door 100, the platform 200, and the actuator 310 is described. Referring to FIG. 5, the door 100 is shown in its lowered position 102 and can be used as a ramp along which a toy vehicle 70 can be moved by a child. The toy vehicle 70 with a toy FIG. 90 can be moved onto platform 200 and disposed in orientation 71 relative to the opening 36 and the door 100. In FIG. 5, the current orientation of the platform 200 is illustrated as orientation 202. The other toy FIG. 80 can be placed on the actuator 310 as shown.

As described in greater detail below, the actuating mechanism 300 is configured so that movement of the actuator 310 in a first direction results in the door 100 moving from its lowered position 102 to its raised position 104. However, due to a biasing mechanism as described below, such movement of the actuator 310 in the first direction does not cause the platform 200 to rotate. In addition, a child may grasp door 100 and move it instead of using the actuator 310. When the actuator 310 is moved in the opposite direction, the door 100 moves from its raised position 104 to its lowered position 102 and the platform 200 is rotated approximately 180° from its initial position. The toy FIG. 80 can be placed in contact with the actuator 310 to facilitate movement of the actuator 310.

Figure 9:
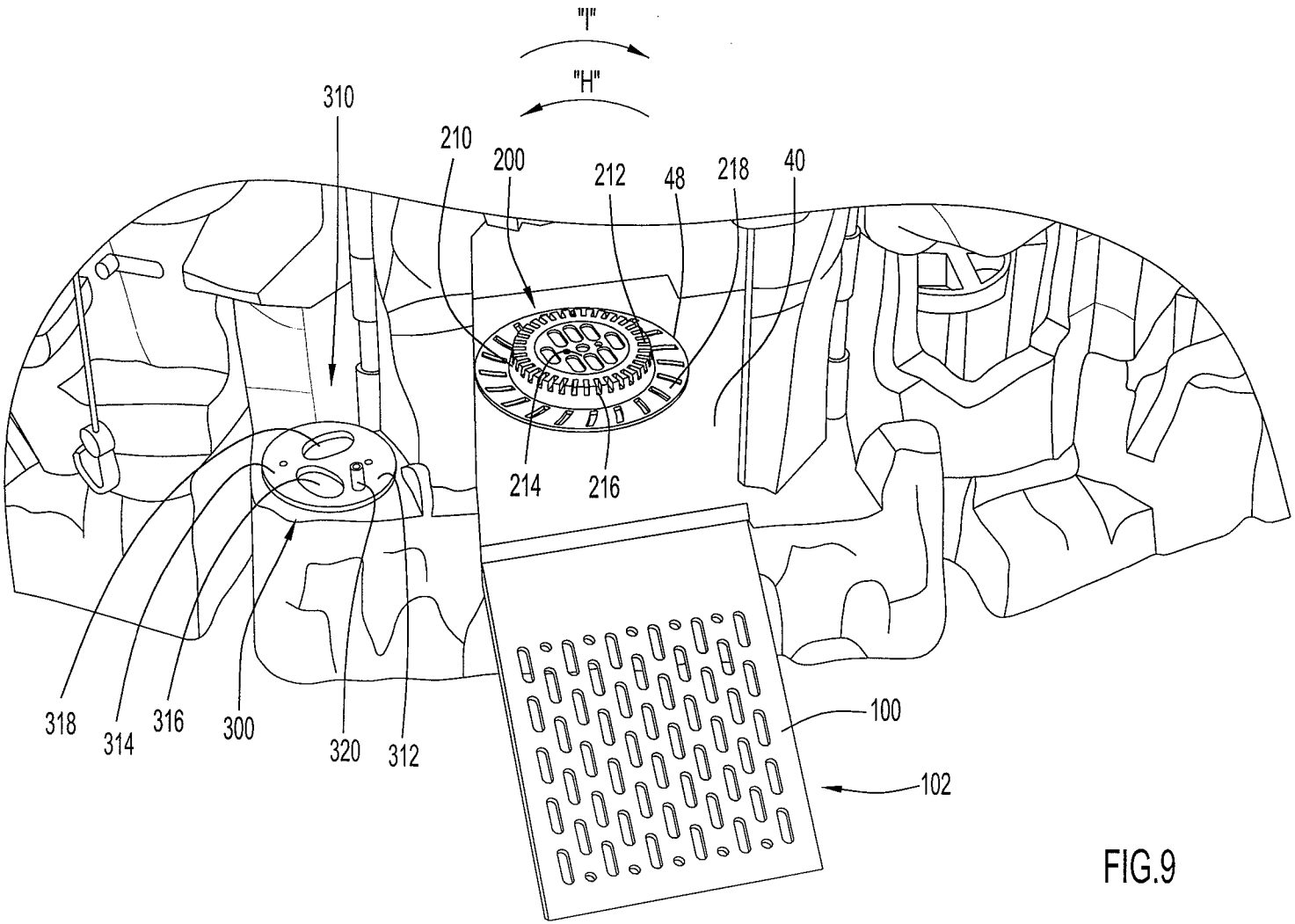
FIG. 9 illustrates a front perspective view of the toy illustrated in FIG. 5.

As shown in FIG. 9, the actuator 310 may include a body 312 with an upper surface with openings 316 and 318 in which the feet 83 and 84 can be disposed. The actuator 310 may include a post 320 that extends upwardly from the body 312. To turn the actuator 310, a child can grasp and move the post 320 or may place toy FIG. 80 into engagement with the actuator 310 and apply a force to the toy FIG. 80 to move the actuator 310.

Referring to FIG. 6, the toy FIG. 80 and actuator 310 are rotated along the direction of arrow "D" to orientations different than those shown in FIG. 5. At the same time as movement of the actuator 310, the door 100 moves from its lowered position 102 along the direction of arrow "E" to its raised position 104.

Figure 7:
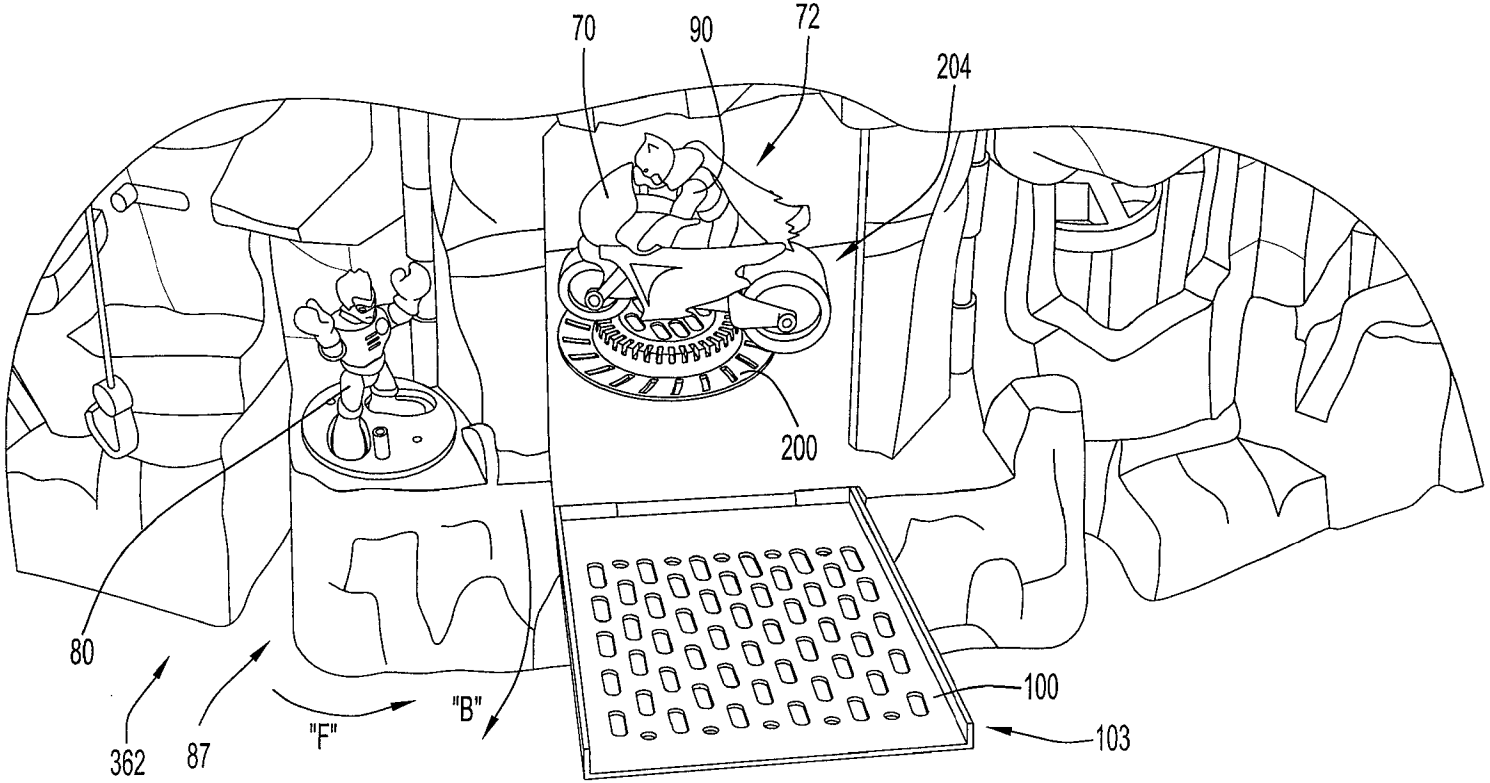
FIG. 7 illustrates a front perspective view of the toy illustrated in FIG. 5 with the door in an intermediate position and the platform in a second orientation.

Referring to FIG. 7, the actuator 310 (and toy FIG. 80 if coupled thereto) are rotated along the direction of arrow "F" to another orientation (orientation 362 for the actuator 310 and orientation 87 for the toy FIG. 80). The movement of the actuator 310 in this direction results in the door 100 moving along the direction of arrow "B" from its raised position 104 (see FIG. 6) to an intermediate position 103 and the platform 200 rotating about an axis to another position or orientation 204. As shown, the toy vehicle 70 with toy FIG. 90 is disposed in an orientation 72 between facing away from the door 100 and facing toward the door 100.

Figure 8:
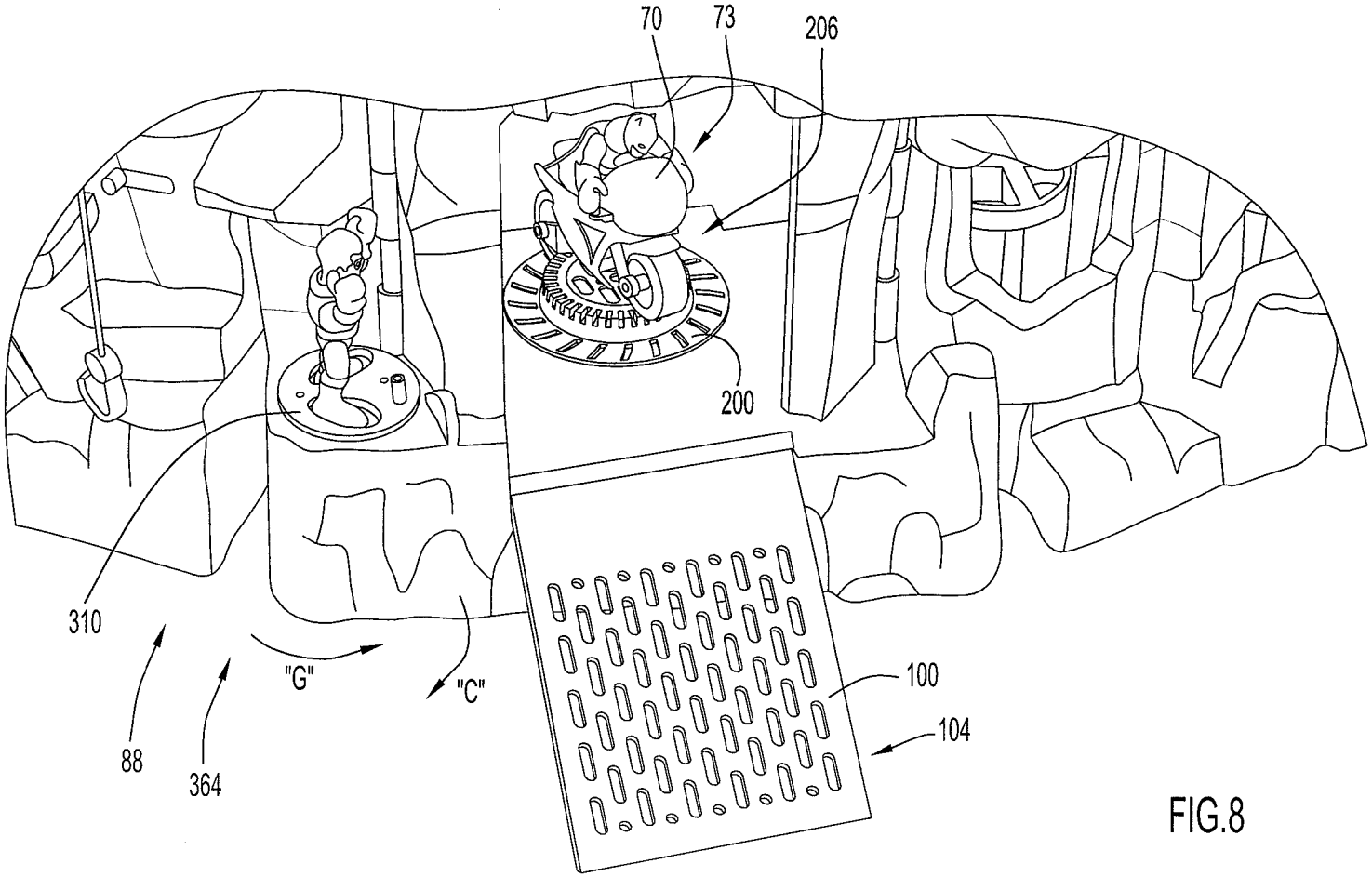
FIG. 8 illustrates a front perspective view of the toy illustrated in FIG. 5 with the door in a lowered position and the platform in a third orientation.

Referring to FIG. 8, as the actuator 310 is moved further along the direction of arrow "G," the door 100 moves along the direction of arrow "C" to its lowered position 104 in which it engages a support surface or an object (not shown). In this position, the toy FIG. 80 is in its orientation 88 and the actuator 310 is in its orientation 364. In addition, the platform 200 moves to the orientation 206 illustrated in FIG. 8 and the toy vehicle 70 moves to an orientation 73 in which the toy vehicle 70 is directed toward the opening 36 and the door 100. The result of the movement of the door 100 from its raised position 104 to its lowered position 102 is that the platform 200 moves from orientation 202 to orientation 206, which corresponds to movement of approximately 180° from its initial position, and the toy vehicle 70 moves from orientation 71 to orientation 73. Accordingly, a toy vehicle 70 that is driven into the housing 20 with its front oriented away from the door 100 will be repositioned or reoriented so that the front of the toy vehicle 70 is directed toward the door 100 when the door 100 is moved from its raised position 104 to its lowered position 102. In this position, the toy vehicle 70 is oriented so that it can be driven straight ahead and out through the opening 36 and down the door 100 for play.

Referring to FIG. 9, the door 100 is shown in its lowered position 102 and some of the details of the platform 200 are illustrated. In one embodiment, the platform 200 can be rotated along the direction of arrow "H" and limited in its movement along the direction of arrow "I," as discussed in greater detail below. The platform 200 includes a body 210 with an upper surface 212 and a center portion 214 that has several recesses 216 defined or formed therein. Around the outside of the center portion 214 is an outer portion 218 that may include several openings or slots formed therein in one embodiment. The body 210 of the platform 200 can be a molded plastic article. The platform 200 is configured so that it is positionable in a recess or chamber 48 formed in the base 40.

Referring to FIGS. 10-14, various views of the components of and embodiment of an actuating mechanism 300 are illustrated. In some drawings, some covers are coupled to the base 40 and in other drawings, the covers are removed from the base 40, thereby permitting the different components of the actuating mechanism 300 to be viewed.

Figure 10:
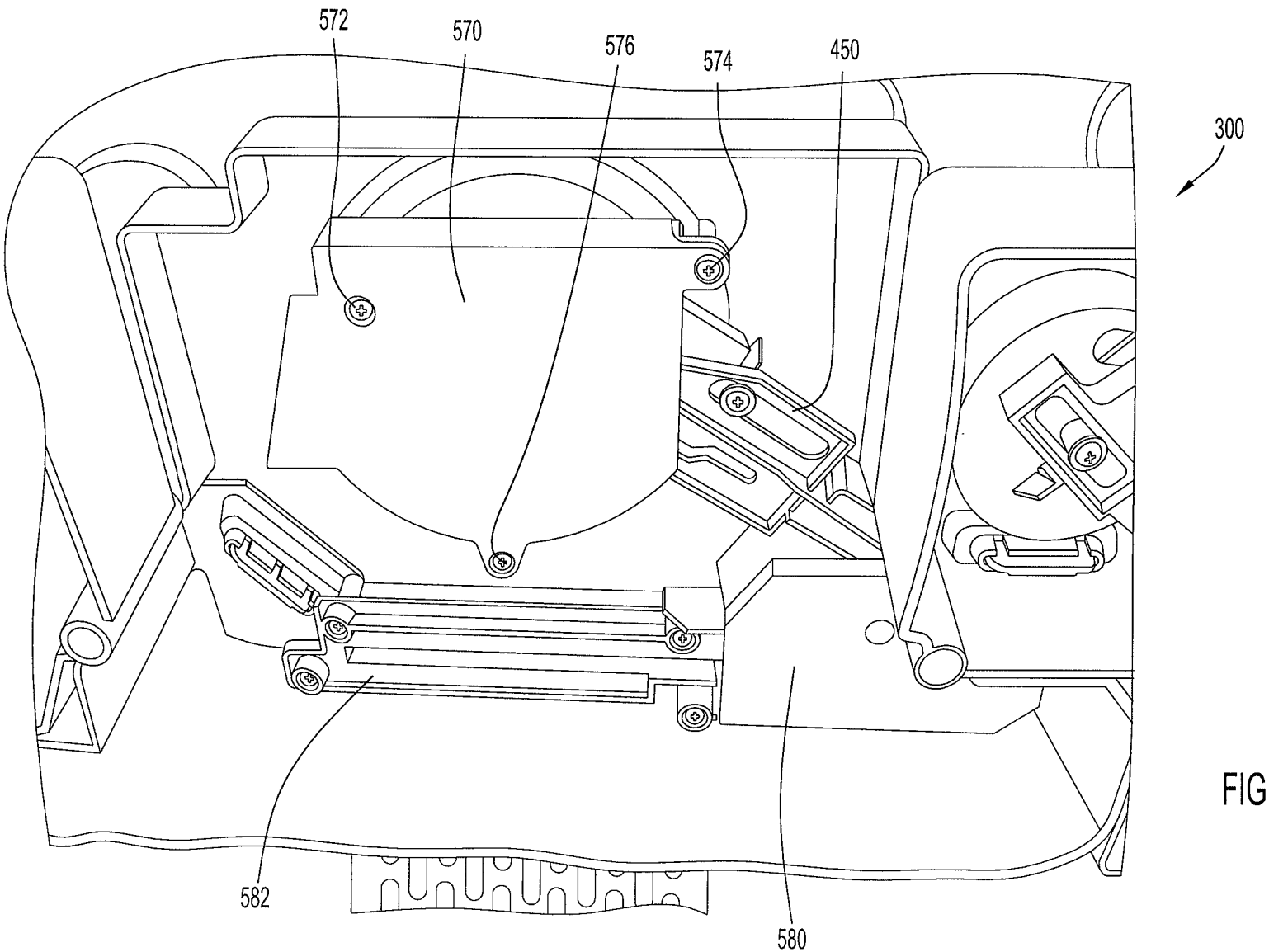
FIG. 10 illustrates a bottom perspective view of the base of the housing illustrated in FIG. 1.

Referring to FIG. 10, a bottom perspective view of the base 40 of the housing 20 is illustrated. As shown, a cover 570 with multiple openings 572, 574, and 576 into which connectors, such as screws, can be inserted and used to mount the cover 570 to the base 40. In addition, a cover 580 with an elongate portion 582 is also coupled to the base 40 by various connectors. A coupling mechanism 450 that is part of the actuating mechanism 300 is illustrated in FIG. 10. The function of the coupling mechanism 450 is described in detail below.

Figure 11:
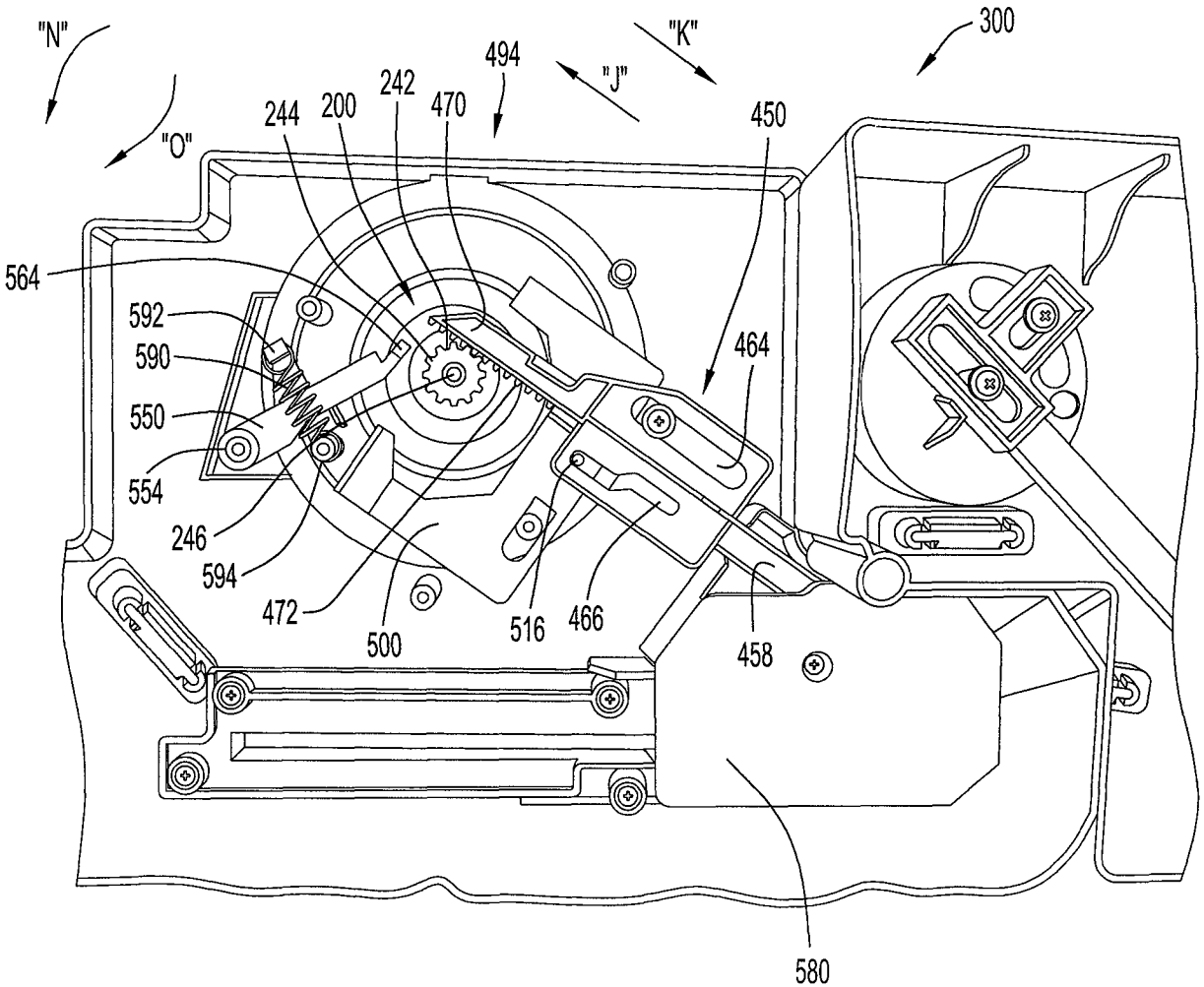
FIG. 11 illustrates a bottom perspective view of the base illustrated in FIG. 10 with a cover removed.

Referring to FIG. 11, the cover 570 has been decoupled from the base 40. The coupling mechanism 450 is mounted for movement along the direction of arrows "J" and "K" in FIG. 11. The coupling mechanism 450 includes an elongate portion 455 and an engagement portion 470 that includes teeth 472 formed thereon. The coupling mechanism 450 includes slots 464 and 466 formed therein that define as well as limit the path of movement of the coupling mechanism 450. A block or member 500 is disposed so that a post 516 on the member 500 engages the slot 466 formed in the coupling mechanism 450.

Figure 17:
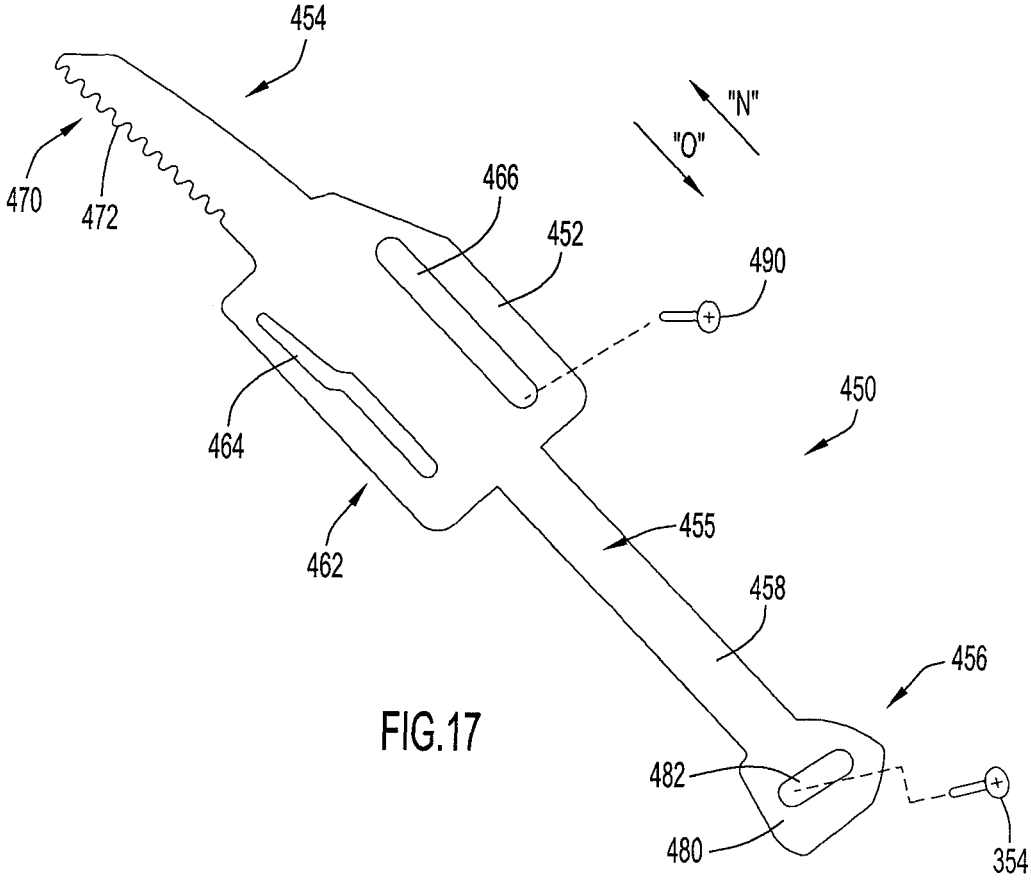
FIG. 17 illustrates a bottom view of an embodiment of a coupling mechanism according to the present invention.
Figure 18:
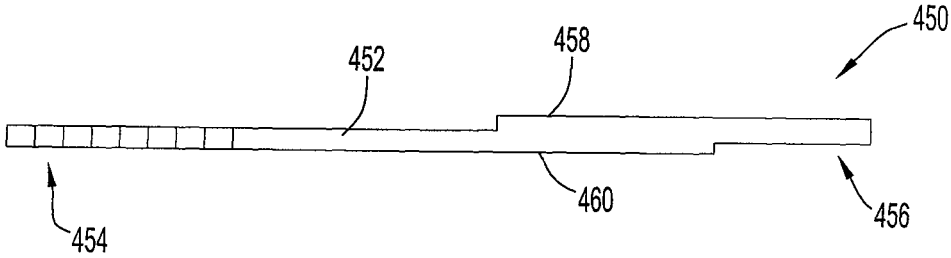
FIG. 18 illustrates a side view of the coupling mechanism illustrated in FIG. 17.

An exemplary embodiment of the coupling mechanism 450 is illustrated in FIGS. 17 and 18. As shown in FIG. 17, the coupling mechanism 450 includes a body 452 with ends 454 and 456. The body 452 has an upper surface 458 and a lower surface 460 (see FIG. 18) and an elongate portion 455 and a mounting portion 462. The mounting portion 462 includes slots 464 and 466 formed therein which are used to guide the coupling mechanism 450 for movement along the direction of arrows "O" and "N." A connector 490, such as a screw, can be inserted into the slot 466. The body 452 includes an engagement portion 470 with teeth 472 proximate to end 454. In addition, the body 452 includes a coupling portion 480 with a slot 482 proximate to end 456. A connector 354, such as a screw, can be inserted into the slot 482. In this embodiment, the coupling mechanism 450 is a plastic article. In other embodiments, the coupling mechanism 450 can be made of different materials.

Referring back to FIG. 11, the lower or bottom side of the platform 200 is illustrated. The platform 200 is moved for rotational movement about the shaft 246 which defines an axis for the motion. Platform 200 includes a gear 242 with teeth 244. Teeth 244 on the platform 200 are configured to be engaged by the teeth 472 on the coupling mechanism 450.

Referring to FIGS. 15A-C and 16, an exemplary embodiment of a platform according to the present invention is illustrated. As shown, the platform 200 includes a body 210 with an upper surface 212, a center portion 214 with recesses 216 formed therearound, and an outer portion 218. The body 210 is mounted to the housing 20 for rotation about axis 250. The recesses 216 are configured to be engaged by the extension 76 that is located on the toy vehicle 70. Accordingly, when the platform 200 rotates or otherwise moves, the toy vehicle 70 moves as well as the toy vehicle 70 is keyed to the platform 200 by way of the extension 76.

The outer portion 218 includes a lower surface 220 and an engagement portion 230. The engagement portion 230 includes a plate 232 with a post or extension 234 extending therefrom. The engagement portion 230 also includes a gear or gear portion 236 that has several teeth formed along its perimeter. The gear 236 is coupled to the body 210 of the platform 200 such that rotation of the gear 236 results in rotation of the body 210 of the platform 200. However, as described below, when the gear 236 is engaged by a latch 550, its movement is prevented, and as a result, the body 210 of the platform 200 does not rotate. In addition, as shown in FIG. 25B, a catch 243 is disposed between the plates 232 and 240. The catch 243 has a body portion 243A with a central opening 243B that is configured to receive the shaft 246. The body portion 243A has three arms 243C that have a slightly outwardly extending tip or point 243D. In other embodiments, the quantity of arms for the catch 243 can vary.

Figure 15A:
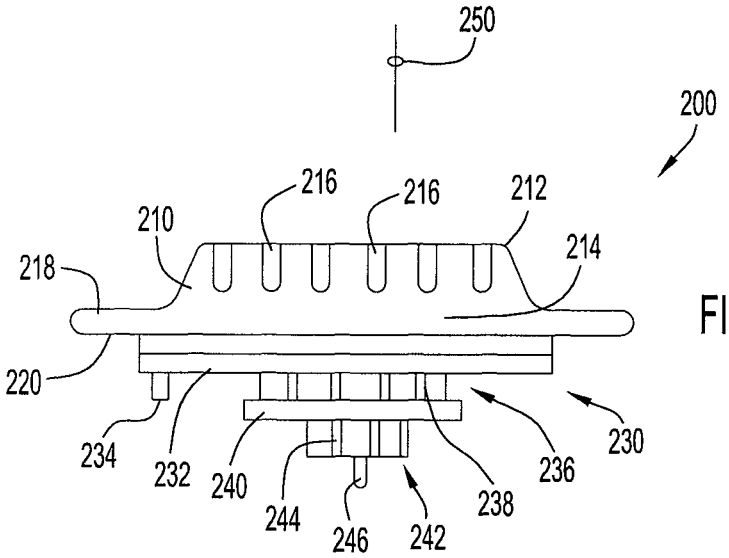
FIGS. 15A-15C illustrate a side view and a partial exploded perspective view, respectively, of an embodiment of a platform according to the present invention.
Figure 15B:
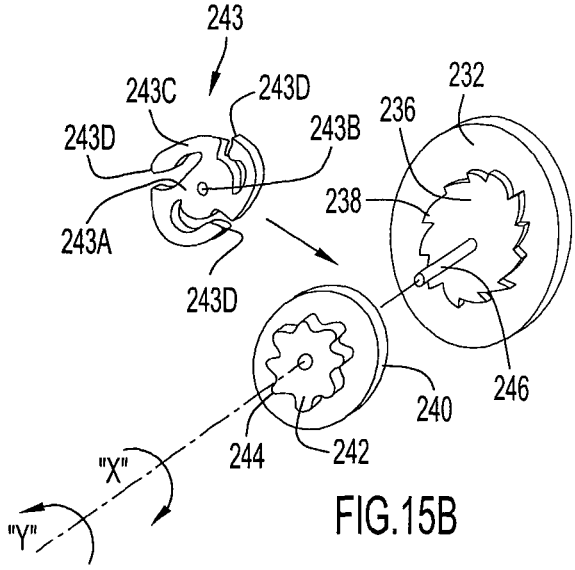
Figure 15C:
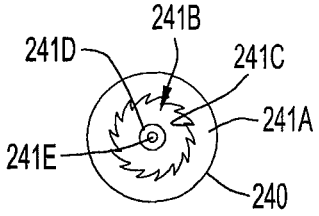

Referring to FIG. 15C, the plate 240 includes an inner surface 241A that is disposed in contact with the gear portion 236. A cavity 241B is formed in the body of the plate 240. The cavity 241B is sized such that the catch 243 is disposable inside of the cavity 241B. Around the perimeter wall defining the cavity 241B are several teeth 241C. The teeth 241C are shaped so that the plate 240 can rotate relative to the catch 243 when the plate 240 rotates in a first direction (see arrow "Y" in FIG. 15B), but the plate 240 and the catch 243 rotate together when the plate 240 rotates in a second direction (see arrow "X" in FIG. 15B). The shape of the teeth 241C slide along the arms 243C of the catch in one direction, but are caught by the tips 243D upon movement of the plate 240 in the other direction. As a result, movement of the plate 240 and teeth 244 is transmitted to the platform 200 in one direction, but not in the other direction. The plate 240 also includes a central portion 241D with a hole 241E through which the shaft 246 can be inserted.

As mentioned above, the plate 240 includes a gear or gear portion 242 with teeth 244. The plate 240 is separately mounted on the shaft 246 and configured to rotate with and/or relative to the plate 232. As described above, teeth 244 on gear 240 are engaged by the teeth 472 on coupling mechanism 450. The teeth 238 on gear 236 are engaged by the tab or projection 564 on the latch 550. The teeth 238 are configured such that the projection 564 can prevent movement of the gear 232 in one direction, but permit movement of the gear 236 in the opposite direction.

As the coupling mechanism 450 moves along the direction of arrow "J" in FIG. 11, the engagement of teeth 472 with teeth 244 moves the plate 240 along the direction of arrow "N." However, movement of plate 232 and the platform 200 along the direction of arrow "N" is limited or prevent by the latch 550 which is held in contact with the teeth 238 by a biasing mechanism or member 590, such as a spring, as well as by the catch 243. The latch 550 includes an end 554 that is coupled to the base 40 and an opposite end that has a tab or projection 564. The projection 564 is configured to engage the teeth 238 and prevent or otherwise limit the movement of the platform 200 along the direction of arrow "N" as the coupling mechanism moves along the direction of arrow "J."

The biasing member 590 has loops 592 and 594 at opposite ends. The biasing member 590 is configured to maintain the projection 564 of latch 550 in engagement with teeth 238 and to store energy. Accordingly, when the door 100 is moved from its lowered position 102 to its raised position 104 (which occurs at the same time as the coupling mechanism 450 moves along arrow "J"), the platform 200 does not rotate and the orientation of the toy vehicle 70 disposed on the platform 200 does not change.

When the coupling mechanism 450 moves along the direction of arrow "K" in FIG. 11, the teeth 472 engage teeth 244 and plate 240 rotates along the direction of arrow "O." In addition, the rotation of plate 240 along that direction results in the platform 200 rotating along the direction of arrow "O" as well. The teeth 238 on gear 236 are configured or shaped to permit movement relative to the projection 564 on the latch 560. Accordingly, the platform 200 freely rotates along arrow "O" as coupling mechanism 450 moves along arrow "K." When the platform 200 rotates, the toy vehicle 70 on the platform 200 also moves and its orientation changes. At the same time, the door 100 moves from its raised position 104 to its lowered position 102, as described below.

Figure 12:
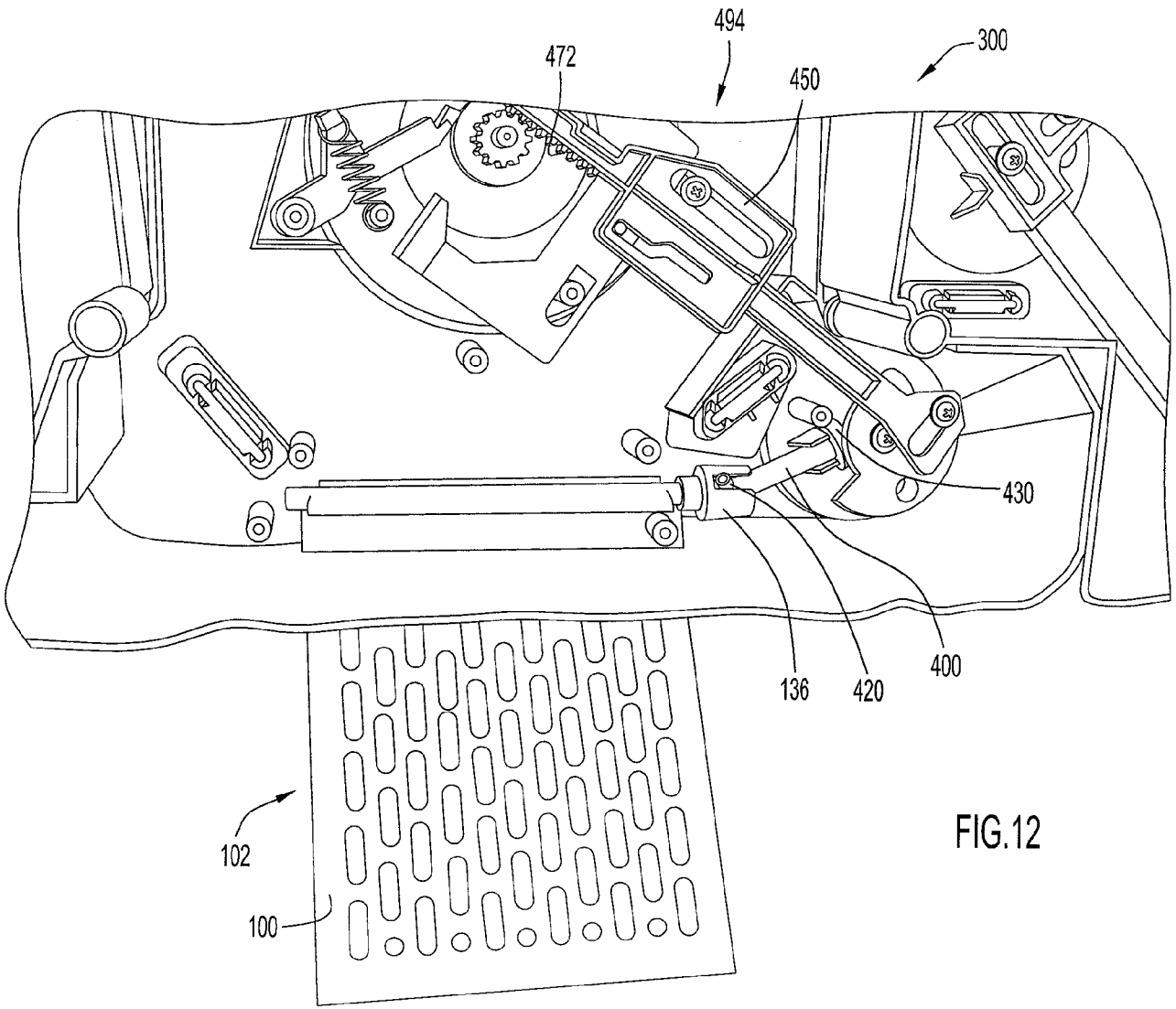
FIG. 12 illustrates a bottom perspective view of the base illustrated in FIG. 11 with another cover removed.
Figure 13:
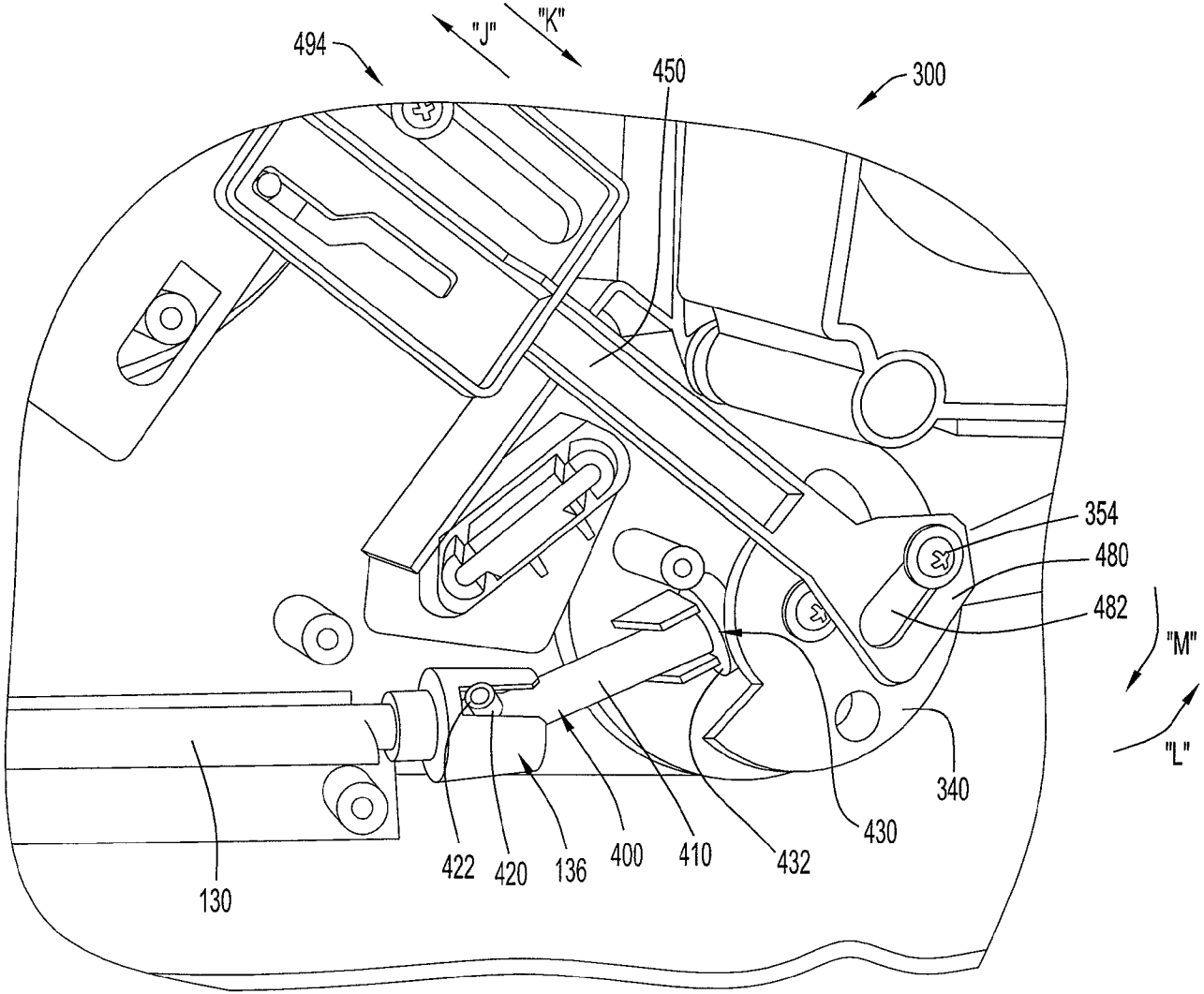
FIG. 13 illustrates a close-up view of some of the components of the actuating mechanism of the toy illustrated in FIG. 1.
Figure 14:
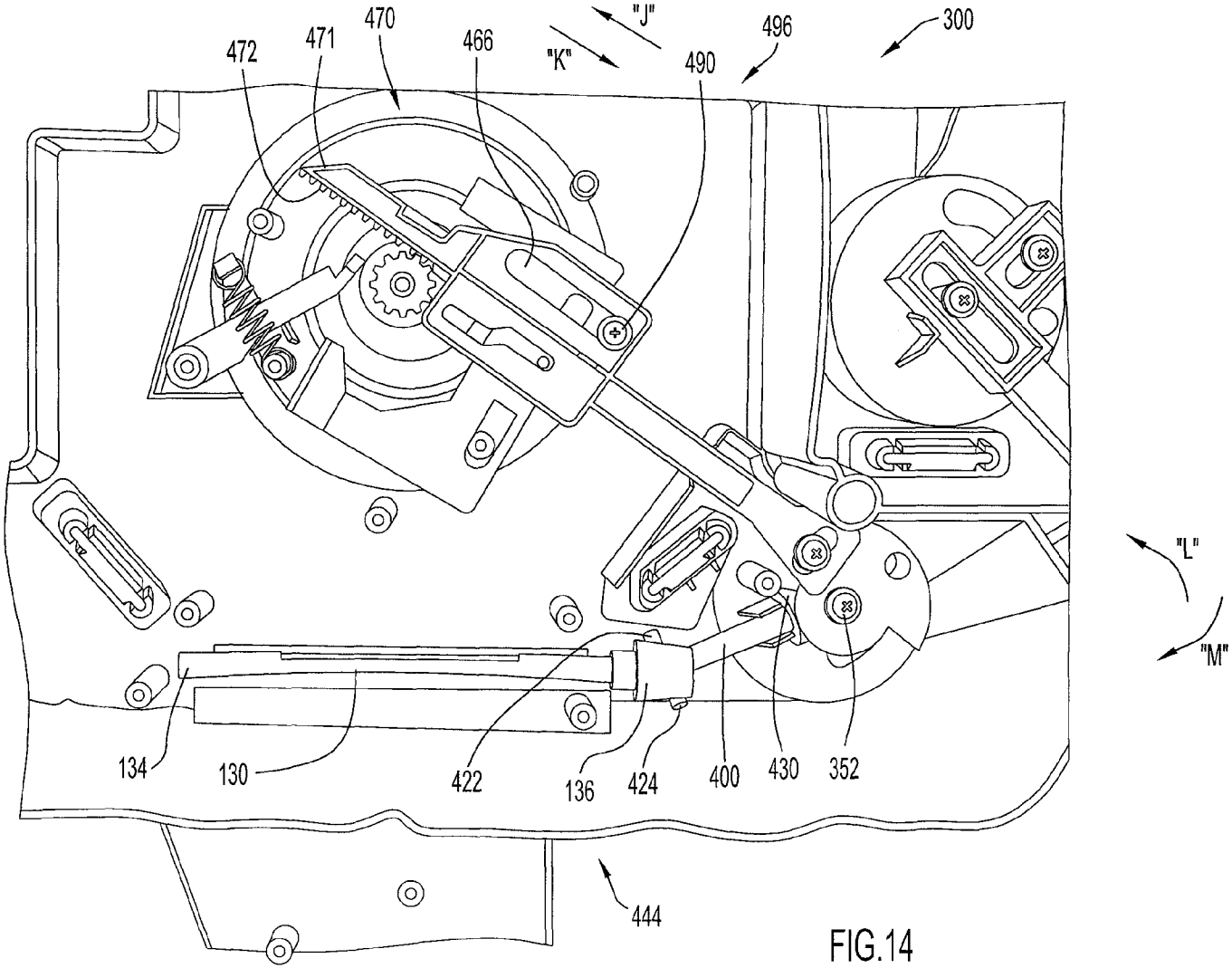
FIG. 14 illustrates a bottom view of the actuating mechanism of the toy illustrated in FIG. 1.
Figure 16:
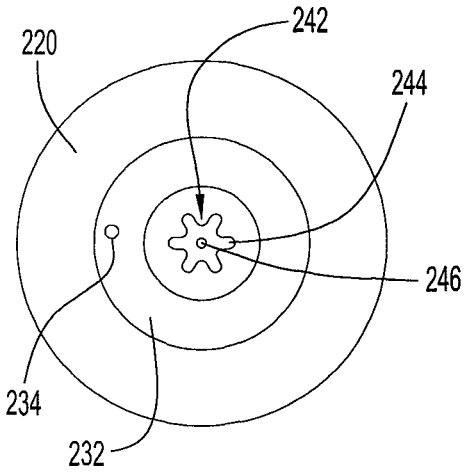
FIG. 16 illustrates a bottom view of the platform illustrated in FIG. 15A.

Referring to FIGS. 12-14, the movement of the door 100 via the actuating mechanism 300 is described. In particular, the door 100 is moved in part by a coupling mechanism 400. An embodiment of the door 100 according to the present invention is illustrated in detail in FIGS. 30 and 31. An embodiment of coupling mechanism 400 according to the present invention is illustrated in detail in FIGS. 27-29.

Figure 30:
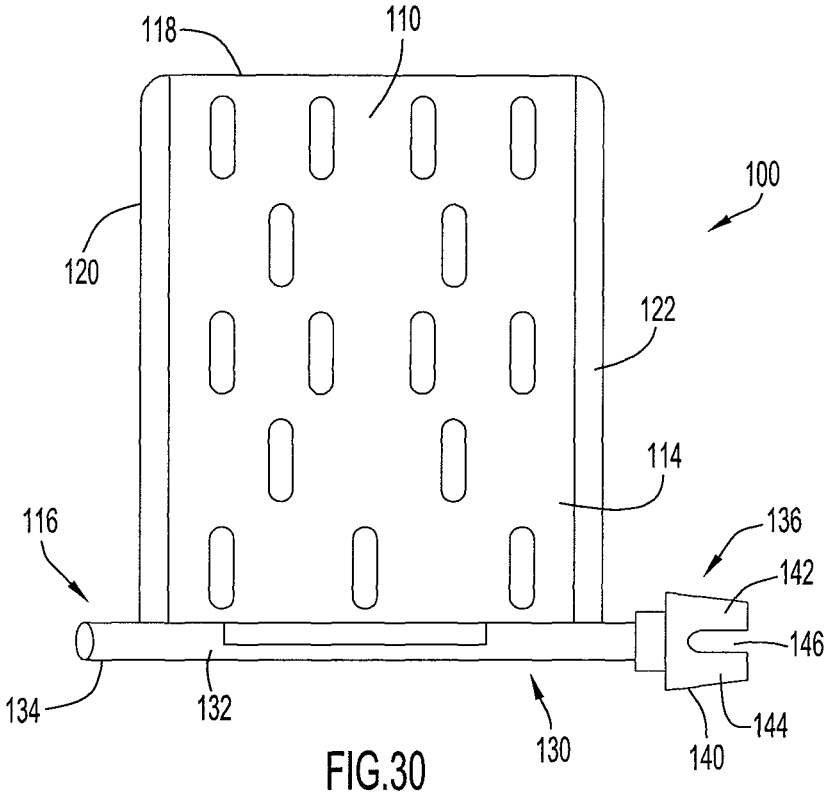
FIG. 30 illustrates a top view of an embodiment of a door according to the present invention.
Figure 31:
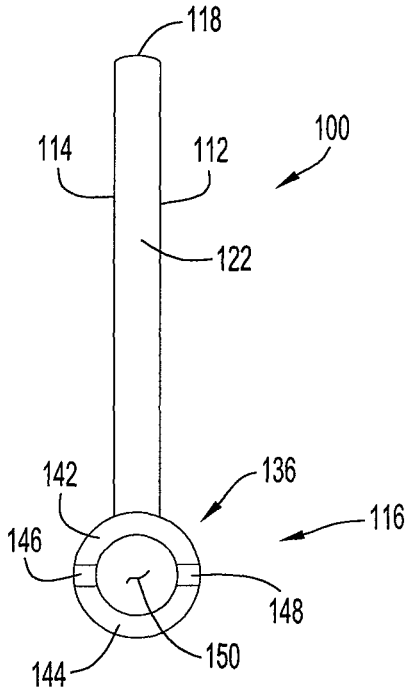
FIG. 31 illustrates a side view of the door illustrated in FIG. 30.

Referring to FIGS. 30 and 31, the door 100 includes a body 110 that has an outer surface 112 and an inner surface 114 relative to how the door 100 is mounted to the housing 20. Sides or side portions 120 and 122 are provided along opposite sides of the door 100 to provide guidance for a toy vehicle 70 that is moved along the door 100. The body 110 also includes a mounting end 116 that is coupled to the housing 20 and a distal end 118 that is opposite the mounting end 116.

The mounting end 116 includes a mounting or engagement portion 130. The mounting portion 130 includes a body or rod portion 132 with opposite ends. At one end is an extension 134 that extends beyond the side of the door 100 for mounting the door 100 to the housing 20. At the other end is a coupler portion 136 that includes a coupler 140 with walls 142 and 144 defining recesses or notches 146 and 148 therebetween. The walls 142 and 144 also define a chamber or cavity 150 as shown in FIG. 31. In one embodiment, the door 100 is a single plastic article. In other embodiments, some of the components of the door 100 can be formed separately and subsequently coupled together, such as by using an adhesive.

Figure 27:
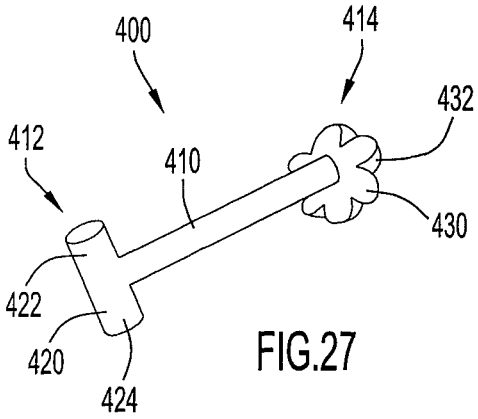
FIG. 27 illustrates a perspective view of a coupling mechanism according to the present invention.
Figure 28:
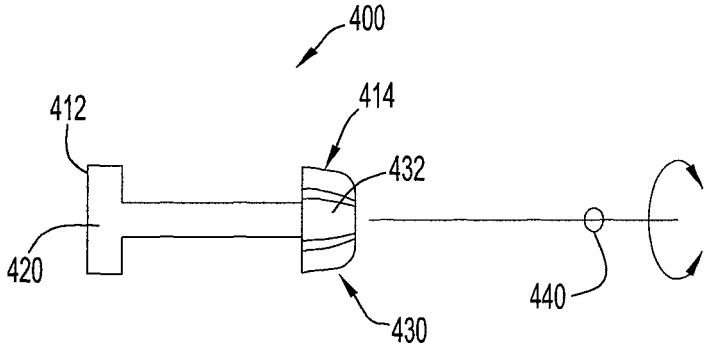
FIG. 28 illustrates a side view of the coupling mechanism illustrated in FIG. 27.
Figure 29:
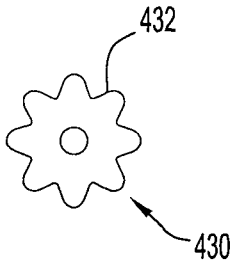
FIG. 29 illustrates an end view of the coupling mechanism illustrated in FIG. 27.

Referring to FIGS. 27-29, an embodiment of a coupling mechanism according to the present invention is illustrated. In this embodiment, the coupling mechanism 400 is a molded plastic article that includes a body 410 with opposite ends 412 and 414. The body 410 has a longitudinal axis 440 about which the coupling mechanism 400 can be mounted for movement. Proximate to end 412 is a coupler or coupler portion 420 that includes extensions 422 and 424. The extensions 422 and 424 are configured to engage the recesses 146 and 148 in the coupler 140 of the door 100. Proximate to end 414 is an engagement portion 430 that includes several teeth 432.

Referring back to FIG. 12, the coupling mechanism 400 is positioned so that its coupling portion 420 is engaged with the coupling or engagement portion 136 of the door 100, which in this position, is in its lowered position 102. The engagement portion 430 is positioned in engagement with the actuator 310. In FIG. 12, the coupling mechanism 450 is illustrated in a position 494 corresponding to the door 100 being in its lowered position 102 and the teeth 472 of the coupling mechanism 450 engaging with the teeth 244.

Figure 25:
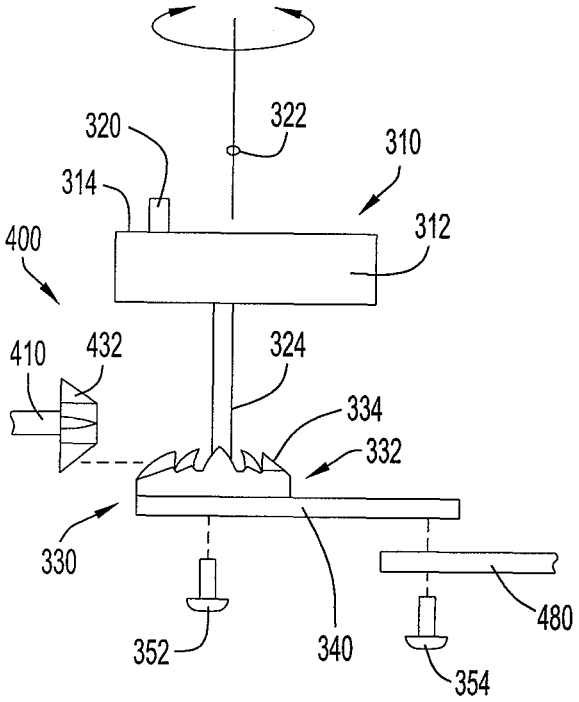
FIG. 25 illustrates a side view of an embodiment of an actuator according to the present invention.
Figure 26:
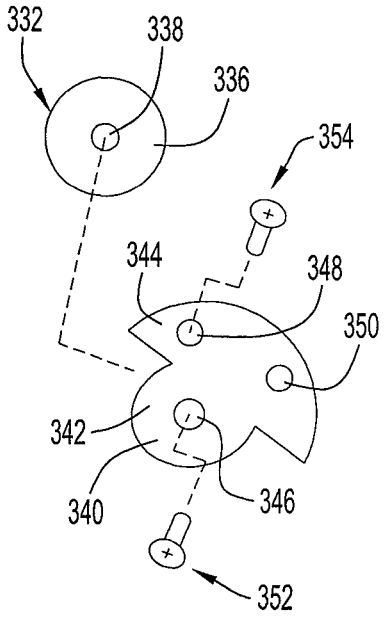
FIG. 26 illustrates a bottom perspective view of a portion of the actuator illustrated in FIG. 25.

Referring to FIGS. 25-26, an exemplary embodiment of an actuator according to present invention is illustrated. The actuator 310 includes a body 312 with an upper surface 314 and a post 320 as previously described. The actuator 310 is mounted for rotational movement about axis 322. Coupled to the body 312 is a shaft 324 with an engagement portion 330. The engagement portion 330 includes a substantially circular gear 332 with teeth 334 formed therein. As shown in FIG. 26, the gear 332 has a lower surface 336 with an opening 338 into which a connector 352, such as a screw, can be inserted to mount a plate 340 thereto. As shown in FIG. 26, the plate 340 includes a center portion 342 and an outer portion 344 as well as several holes 346, 348, and 350 formed therethrough. A connector 354 can be used to couple the coupling portion 480 of the coupling mechanism 450 to the plate 340.

As shown in FIG. 25, coupling mechanism 400 can be disposed so that the teeth 432 of the engagement portion 430 are in engagement with the teeth 334 of the actuator 310. As the actuator 310 rotates, the coupling mechanism 400 rotates about its axis 440 when the sets of teeth are engaged.

Referring back to FIG. 13, when the coupling mechanism 400 rotates about its axis 440, motion is imparted to the door 100 depending on the direction of rotation of the coupling mechanism 400. The coupling mechanism 400 is disposed so that the engagement portion 430 engages the teeth 334 of the actuator 310 which can be rotated along the directions of arrows "L" and "M." The coupling or engagement portion 420 of the coupling mechanism 400 is engaged so that the extensions 422 and 424 are inserted into the notches 146 and 148 in the coupler 136. As the coupling mechanism 400 rotates, the coupler 136 moves from a position 442 in which the door 100 is in its raised position to a position 444 in which the door 100 is in its lowered position.

Likewise, as the actuator 310 rotates, the plate 340 also rotates. A connector 354 coupled to the plate 340 moves along the slot 482 in the coupling portion 480 and imparts reciprocating motion to the coupling mechanism 450 along the directions of arrows "J" and "K." Movement of the plate along the direction of arrow "L" causes the coupling mechanism 450 to move along the direction of arrow "J" to its position 496 shown in FIG. 14. However, such movement by the coupling mechanism 450 does not result in the platform 200 moving because of the latch 550. In this position, the portion of the teeth 472 farthest from the distal end 471 is engaged with teeth 244. As the plate 340 moves along the direction of arrow "M," the coupling mechanism 450 moves along the direction of arrow "K" to its position 494 (see FIGS. 11 and 13) and the teeth 472 move the teeth 244 and the platform 200 along the direction of arrow "M" thereby aligning the toy vehicle 70 toward the door 100. At the end of this movement, the teeth 472 proximate to the distal end 471 are in engagement with the teeth 244.

Figure 19:
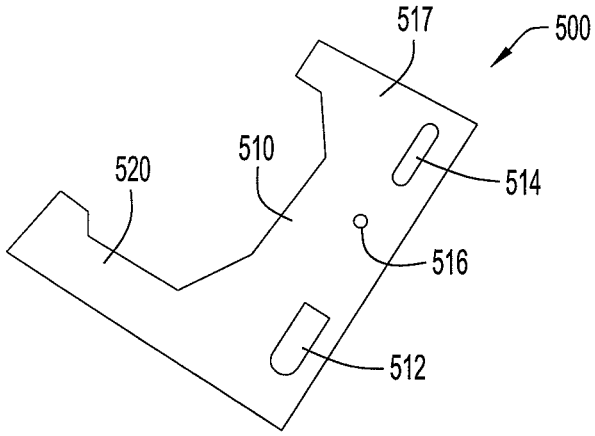
FIG. 19 illustrates a bottom view of an embodiment of a cover according to the present invention.
Figure 20:
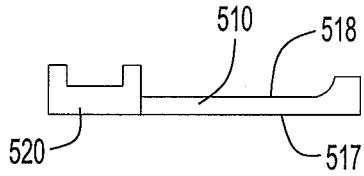
FIG. 20 illustrates a side view of the cover illustrated in FIG. 19.
Figure 21:
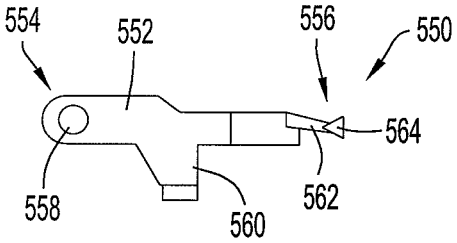
FIG. 21 illustrates a top view of an embodiment of a latch according to the present invention.
Figure 23:
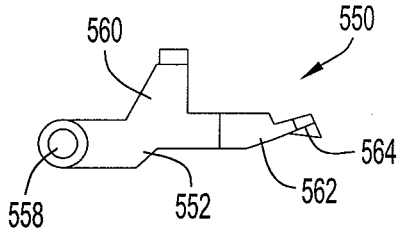
FIG. 23 illustrates a bottom view of the latch illustrated in FIG. 21.
Figure 22:
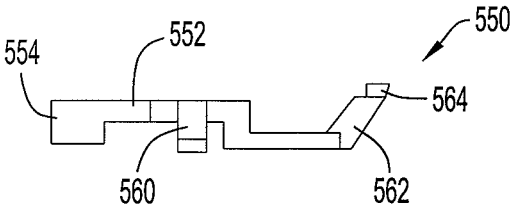
FIG. 22 illustrates a side view of the latch illustrated in FIG. 21.
Figure 24:
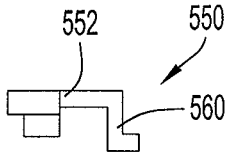
FIG. 24 illustrates an end view of the latch illustrated in FIG. 21.

Referring to FIGS. 19 and 20, an embodiment of a cover or block according to the present invention is illustrated. In this embodiment, the cover 500 includes a body 510 with slots 512 and 514 as well as a post or extension 516. The body 510 also includes an upper surface 518, a lower surface 517, and an extension 520.

Referring to FIGS. 21-24, an embodiment of the latch 550 according to the present invention is illustrated. In this embodiment, the latch 550 includes a body 552 with ends 554, and 556. An opening 558 is disposed at end 554 and is configured to be used to mount the latch 550 to a post formed on the lower surface of the base 40. The body 552 includes a support 560 and an extension 562 with a tab or projection 564.

The various components of the toy can be formed of plastic and can be molded articles. In other embodiments, different materials can be used. In other embodiments, the extent to which the platform rotates can vary.

Thus, when a toy vehicle 70 is driven up the ramp or door 100 and onto the platform 200, a child may move the door 100 manually or use the actuator or activation disk 300 to move the ramp or door 100 from its lowered position 102 to its raised position 104. The movement of the door 100 from position 102 to position 104 does not result in the movement of the platform 200. Accordingly, the toy vehicle 70 remains in the same orientation as it was initially placed on the platform 200. When desired, the actuator 310 can be rotated by a child so that the door 100 moves from its raised position 104 to its lowered position 102 and the platform 200 rotate with the toy vehicle 70 thereon. Alternatively, the door 100 may be grasped by a child and moved downwardly to cause the platform 200 to rotate.

While the invention has been described in detail and with reference to specific embodiments thereof, it will be apparent to one skilled in the art that various changes and modifications can be made therein without departing from the spirit and scope thereof. For example, it is to be understood that terms such as "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. A toy playset, comprising:

a housing, the housing including a wall having an inner side and an outer side, the wall defining an opening extending from the inner side to the outer side, the housing defining a receiving area;

a door, the door being coupled to the wall proximate to the opening, the door being movable between a raised position and a lowered position;

a platform, the platform being movably mounted to the housing and located in the receiving area, the platform being movable from a first position to a second position, the platform being both structurally linked to the door and moving from its first position to its second position as the door moves from its raised position to its lowered position; and an actuator coupled to the housing, wherein the actuator is configured to move the door from its lowered position to its raised position.

2. The toy playset of claim 1, wherein the door and the platform are configured so that a toy vehicle can be moved from the outer side of the housing to the inner side of the housing along the door and onto the platform, and the platform is configured to receive the toy vehicle.

3. The toy playset of claim 1, wherein the platform is configured to move so that a toy vehicle disposed on the platform in a first orientation relative to the opening while the door is in its raised position is moved to a second orientation relative to the opening when the platform moves from its first position to its second position.

4. The toy playset of claim 3, wherein the toy vehicle is oriented away from the opening in its first orientation and the toy vehicle is oriented toward the opening in its second orientation.

5. The toy playset of claim 1, further comprising: a toy vehicle, the toy vehicle being disposable in a first orientation relative to the opening when the platform is in its first position, the toy vehicle moving to a second orientation relative to the opening as the platform moves to its second position, the second orientation being opposite to the first orientation.

6. The toy playset of claim 1, wherein the platform remains stationary as the door moves from its lowered position to its raised position.

7. The toy playset of claim 1, wherein the platform rotates approximately 180° as the platform moves from its first position to its second position.

8. The toy playset of claim 1, wherein the actuator is coupled to the housing and movable in a first direction and in a second direction opposite to the first direction, the actuator being coupled to the door and to the platform, and movement of the actuator in the first direction causes the door to move from its lowered position to its raised position.

9. The toy playset of claim 8, wherein movement of the actuator in the second direction causes the platform to rotate and the door to move from its raised position to its lowered position.

10. The toy playset of claim 8, further comprising:

a first coupling mechanism, the first coupling mechanism being operably coupled to the actuator and to the platform; and a second coupling mechanism, the second coupling mechanism being operably coupled to the actuator and to the door, and movement of the actuator causes actuation of the first coupling mechanism and the second coupling mechanism.

11. The toy playset of claim 10, wherein the actuator includes an engagement portion and the platform includes an engagement portion, the first coupling mechanism includes a first portion and a second portion, the first portion of the first coupling mechanism being configured to operably engage the engagement portion of the actuator, and the second portion of the first coupling mechanism being configured to operably engage the engagement portion of the actuator.

12. The toy playset of claim 11, wherein the door includes an engagement portion, the second coupling mechanism includes a first portion and a second portion, the first portion of the second coupling mechanism being configured to operably engage the engagement portion of the actuator, and the second portion of the second coupling mechanism being configured to operably engage the engagement portion of the door.

13. A toy, comprising:

a housing, the housing defining an opening extending therethrough;

a door, the door being coupled to the housing proximate to the opening, the door being movable between a raised position in which the door closes a portion of the opening and a lowered position in which the door forms a ramp up to the opening;

a platform, the platform being rotatably coupled to the housing, the platform being both structurally linked to the door and movable from a first position to a second position as the door is moved from its raised position to its lowered position; and a toy vehicle, the toy vehicle being configured to be moved along the door, the toy vehicle being disposable on the platform in a first orientation when the platform is in its first position, and the toy vehicle being moved to a second orientation as the platform moves from its first position to its second position, the second orientation being different than the first orientation.

14. The toy of claim 13, wherein the platform is mounted for movement around an axis, the platform being configured to move incrementally in a direction around the axis for each movement of the door from its lowered position to its raised position.

15. The toy of claim 13, further comprising:

an actuator, the actuator being operably coupled to the door and to the platform, the actuator being configured to be moved in a first direction and in a second direction opposite to the first direction, movement of the actuator in the first direction causes the door to move from its lowered position to its raised position and the platform from its first position to its second position, and movement of the actuator in the second direction cause the door to move from its raised position to its lowered position and the platform from its second position to its first position.

16. The toy of claim 15, wherein the toy vehicle is facing away from the door when the toy vehicle is in its first position and the toy vehicle is facing toward the door when the toy vehicle is in its second position.

17. The toy playset of claim 1, wherein:

the actuator is movable in a first actuator direction and in a second actuator direction opposite the first actuator direction, and the actuator is in communication with each of the door and the platform such that movement of the actuator simultaneously moves both the door and the platform.

18. The toy playset of claim 1, wherein the actuator is further configured to move the platform from its first platform position to its second platform position.

19. The toy playset of claim 1, wherein the actuator is further configured to move the door from it raised position to its lowered position.

20. A toy play set comprising:

a housing, the housing including a wall having an inner side and an outer side, the wall defining an opening extending from the inner side to the outer side, the housing defining a receiving area;

a door, the door being coupled to the wall proximate to the opening, the door being movable between a raised position and a lowered position;

a platform including an engagement portion, the platform being movably mounted to the housing and located in the receiving area, the platform being movable from a first position to a second position, the platform moving from its first position to its second position as the door moves from its raised position to its lowered position;

an actuator including an engagement portion, the actuator being configured to move the door from its lowered position to its raised position, wherein:

the actuator is coupled to the housing and movable in a first direction and in a second direction opposite to the first direction, the actuator is coupled to the door and to the platform, and movement of the actuator in the first direction causes the door to move from its lowered position to its raised position;

a first coupling mechanism including a first portion and a second portion, the first coupling mechanism being operably coupled to the actuator and to the platform; and a second coupling mechanism, the second coupling mechanism being operably coupled to the actuator and to the door, and movement of the actuator causes actuation of the first coupling mechanism and the second coupling mechanism, wherein the first portion of the first coupling mechanism is configured to operably engage the engagement portion of the actuator and the second portion of the first coupling mechanism is configured to operably engage the engagement portion of the actuator.

* * * * *

UNITED STATES PATENT AND TRADEMARK OFFICE

CERTIFICATE OF CORRECTION

PATENT NO. : 8,591,284 B2
APPLICATION NO. : 12/559134
DATED : November 26, 2013
INVENTOR(S) : Dubois It is certified that error appears in the above-identified patent and that said Letters Patent is hereby corrected as shown below:

In the Specification

Column 5, line 40, both occurrences, change "FIG." to --figure--;
Column 5, line 41, second occurrence, change "FIG." to --figure--;
Column 5, line 45, second occurrence, change "FIG." to --figure--.

Column 6, line 8, change "FIG." to --figure--;
Column 6, line 11, change "FIG." to --figure--;
Column 6, line 12, second occurrence, change "FIG." to --figure--;
Column 6, line 13, change "FIG." to --figure--;
Column 6, line 16, change "FIG." to --figure--;
Column 6, line 27, change "FIG." to --figure--;
Column 6, line 31, change "FIG." to --figure--;
Column 6, line 44, change "FIG." to --figure--;
Column 6, line 51, change "FIG." to --figure--;
Column 6, line 52, change "FIG." to --figure--;
Column 6, line 54, change "FIG." to --figure--;
Column 6, line 60, second occurrence, change "FIG." to --figure--;
Column 6, line 63, change "FIG." to --figure--.

Column 7, line 1, change "FIG." to --figure--;
Column 7, line 8, change "FIG." to --figure--.

Signed and Sealed this
Eighth Day of July, 2014

Michelle K. Lee

Michelle K. Lee
*Deputy Director of the United States Patent and Trademark Office*